US007503804B2

(12) United States Patent
Minich

(10) Patent No.: US 7,503,804 B2
(45) Date of Patent: Mar. 17, 2009

(54) BACKPLANE CONNECTOR

(75) Inventor: Steven E. Minich, York, PA (US)

(73) Assignee: FCI Americas Technology Inc., Reno, NV (US)

( * ) Notice: Subject to any disclaimer, the term of this patent is extended or adjusted under 35 U.S.C. 154(b) by 0 days.

(21) Appl. No.: 11/726,936

(22) Filed: Mar. 23, 2007

(65) Prior Publication Data

US 2008/0146046 A1 Jun. 19, 2008

Related U.S. Application Data

(60) Provisional application No. 60/870,791, filed on Dec. 19, 2006, provisional application No. 60/870,793, filed on Dec. 19, 2006, provisional application No. 60/870,796, filed on Dec. 19, 2006.

(51) Int. Cl.
*H01R 13/648* (2006.01)

(52) U.S. Cl. ..... 439/608

(58) Field of Classification Search ..... 439/608, 439/701, 79

See application file for complete search history.

(56) References Cited

U.S. PATENT DOCUMENTS

| | | | | |
|---|---|---|---|---|
| 5,429,520 | A | 7/1995 | Morlion et al. | 439/108 |
| 5,672,064 | A | 9/1997 | Provencher et al. | 439/79 |
| 5,795,191 | A | 8/1998 | Preputnick et al. | 439/608 |
| 5,860,816 | A | 1/1999 | Provencher et al. | 439/79 |
| 6,132,255 | A | 10/2000 | Verhoeven | 439/608 |
| 6,409,543 | B1 | 6/2002 | Astbury, Jr. et al. | 439/608 |
| 6,503,103 | B1 | 1/2003 | Cohen et al. | 439/608 |
| 6,565,388 | B1 | 5/2003 | Van Woensel et al. | 439/610 |
| 6,592,381 | B2 | 7/2003 | Cohen et al. | 439/80 |
| 6,607,402 | B2 | 8/2003 | Cohen et al. | 439/608 |
| 6,712,646 | B2 * | 3/2004 | Shindo | 439/608 |
| 6,872,085 | B1 | 3/2005 | Cohen et al. | 439/108 |
| 6,884,117 | B2 | 4/2005 | Korsunsky et al. | 439/607 |
| 7,101,191 | B2 | 9/2006 | Benham et al. | 439/65 |
| 7,270,574 | B1 | 9/2007 | Ngo | 439/608 |
| 2001/0012729 | A1 | 8/2001 | Van Woensel | 439/608 |
| 2001/0046810 | A1 | 11/2001 | Cohen et al. | 439/608 |
| 2005/0048838 | A1 | 3/2005 | Korsunsky et al. | 439/607 |

OTHER PUBLICATIONS

Teradyne Connection Systems, Inc., Customer Use Drawing No. C-163-5101-500, Rev. 04.

TB-2127 "Ventura™ Application Design", Revision ",General Release", Specification Revision Status—B. Hunsaker, Aug. 25, 2005, Amphenol Corporation 2006, pp. 1-13.

* cited by examiner

*Primary Examiner*—Javaid Nasri
(74) *Attorney, Agent, or Firm*—Harrington & Smith, PC

(57) ABSTRACT

Disclosed herein is an organizer for a backplane connector. The organizer includes a first extending portion and a second extending portion. The first extending portion includes a plurality of first openings. The plurality of first openings are configured to receive at least one first projecting member from a first side of a plurality of leadframe assemblies. The second extending portion is connected to the first extending portion. The second extending portion includes a plurality of second openings configured to receive at least one second projecting member from a second side of the leadframe assemblies. The second extending portion includes at least one contact section configured to be electrically connected to an electronic component.

30 Claims, 23 Drawing Sheets

BACKPLANE CONNECTOR

CROSS REFERENCE TO RELATED APPLICATION

This application claims priority under 35 U.S.C. §119(e) to U.S. provisional patent application No. 60/870,791 filed Dec. 19, 2006, U.S. provisional patent application No. 60/870,793 filed on Dec. 19, 2006, and U.S. provisional patent application No. 60/870,796 filed on Dec. 19, 2006, which are all hereby incorporated by reference in their entireties.

BACKGROUND OF THE INVENTION

1. Field of the Invention

The present invention relates to an electrical connector and, more particularly, to a backplane connector having connector modules or leadframe assemblies.

2. Brief Description of Prior Developments

U.S. Pat. Nos. 5,429,520 and 6,565,388 disclose electrical connector assemblies having various shielding and housing configurations. Electrical connectors provide signal, power and data connections between electronic components. These electronic components may be mounted on printed circuit boards (including motherboards, backplane boards, and daughterboards, for example) to form an electronic system, such as a computer for example.

Backplane connectors (also known as back panel connectors, right angle connectors, and 90 degree connectors) offer high speed signal routing between printed circuit boards (PCBs) such as backpanels, daughter cards, and midplanes, for example. Due to the demand for miniaturized electronic devices capable of high speed electronic communication, connectors which are smaller and lighter while providing the same or better performance characteristics are desired in the industry. Additionally, as contacts within the connectors become more closely spaced, undesirable electromagnetic interference issues have become more prevalent.

Accordingly there is a need for customizable electrical connectors providing high speed connections with reduced size and weight configurations. Additionally, there is a continuing need to provide electromagnetic shielding to the connectors and surrounding components.

SUMMARY OF THE INVENTION

In accordance with one aspect of the present invention, an organizer for a backplane connector is disclosed. The organizer includes a first extending portion and a second extending portion. The first extending portion includes a plurality of first openings. The plurality of first openings are configured to receive at least one first projecting member from a first side of a plurality of leadframe assemblies. The second extending portion is connected to the first extending portion. The second extending portion includes a plurality of second openings configured to receive at least one second projecting member from a second side of the leadframe assemblies. The second extending portion includes at least one contact section configured to be electrically connected to an electronic component.

In accordance with another aspect of the present invention, an electrical connector is disclosed. The electrical connector includes a plurality of adjacently disposed leadframe assemblies and a retainer. Each of the leadframe assemblies includes a first side comprising at least one first projecting member. Each of the leadframe assemblies includes a second side comprising at least one second projecting member. The retainer includes a first extending portion and a second extending portion. The first extending portion includes a plurality of first openings which receive the at least one first projecting members. The second extending portion includes a plurality of second openings which receive the at least one second projecting members.

In accordance with yet another aspect of the present invention, a backplane connector is disclosed. The backplane connector includes a plurality of first leadframe assemblies, a plurality of second leadframe assemblies, and a leadframe assembly retainer. Each of the first leadframe assemblies includes a recessed portion along a mating side of the leadframe assembly. Each of the second leadframe assemblies is disposed adjacent to one of the first leadframe assemblies. Each of the second leadframe assemblies includes a recessed portion along a mating side of the second leadframe assembly. The leadframe assembly retainer is connected to the plurality of first leadframe assemblies and the plurality of second leadframe assemblies. The first leadframe assemblies and the second leadframe assemblies are fixedly disposed adjacent to one another. The recessed portions of the first leadframe assemblies and the second leadframe assemblies combine to form a plurality of slots configured to receive a plurality of guide posts from a mating electrical connector. A width of each of the slots is greater than a width of the individual recessed portions of the first and second leadframe assemblies.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENTS

Figure 1:
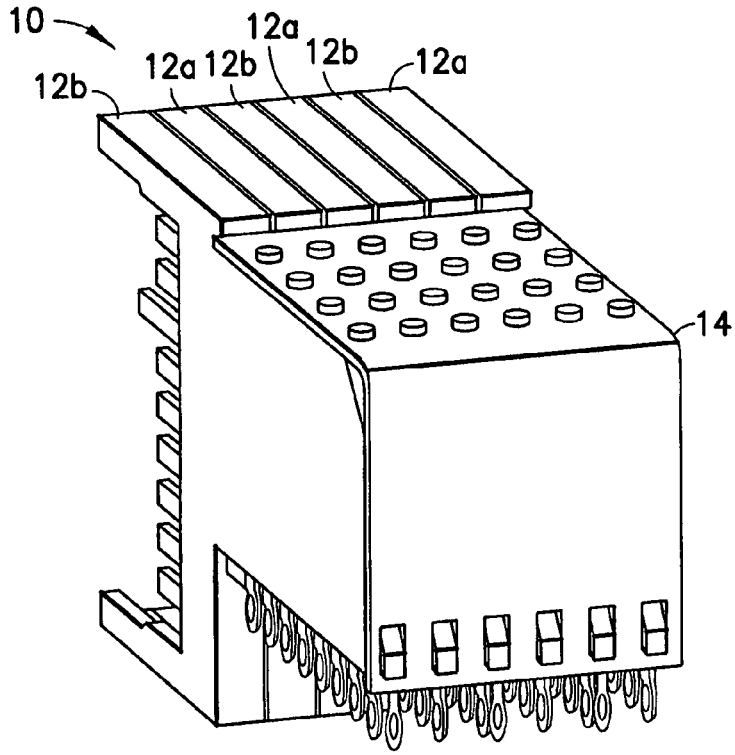
FIG. 1 is a perspective view of a backplane connector.

Referring to FIG. 1, there is shown a perspective view of a backplane connector 10 incorporating features of the present invention. Although the present invention will be described with reference to the exemplary embodiments shown in the drawings, it should be understood that the present invention can be embodied in many alternate forms of embodiments. In addition, any suitable size, shape or type of elements or materials could be used.

Figure 2:
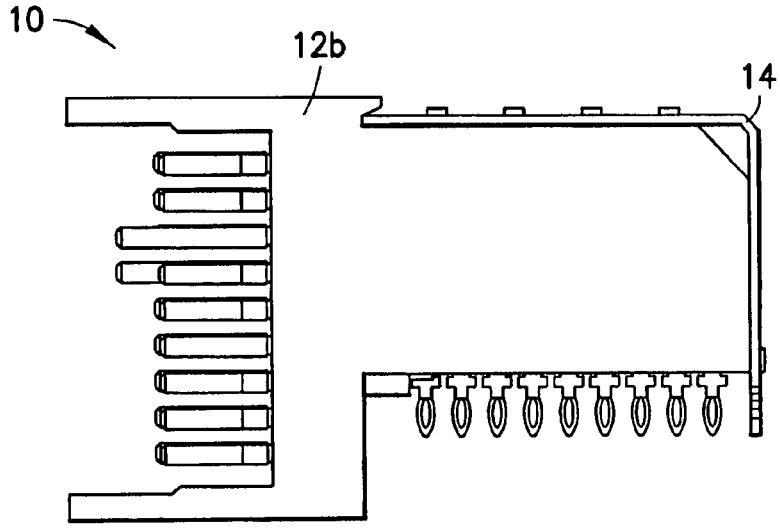
FIG. 2 is a side view of the backplane connector shown in FIG. 1.
Figure 3:
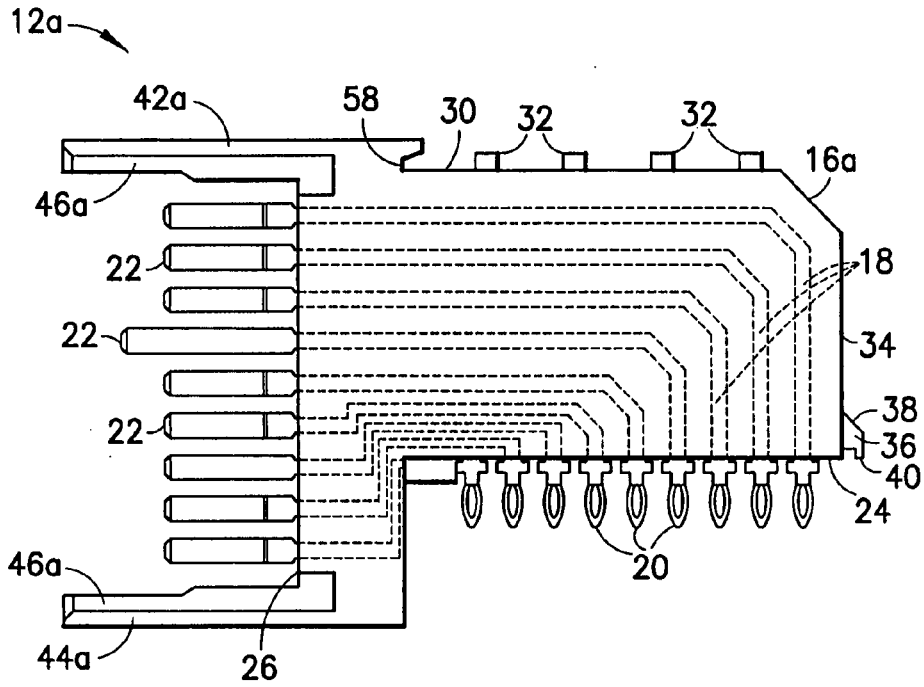
FIG. 3 is a side view of a first connector module used in the connector shown in FIG. 1.
Figure 4:
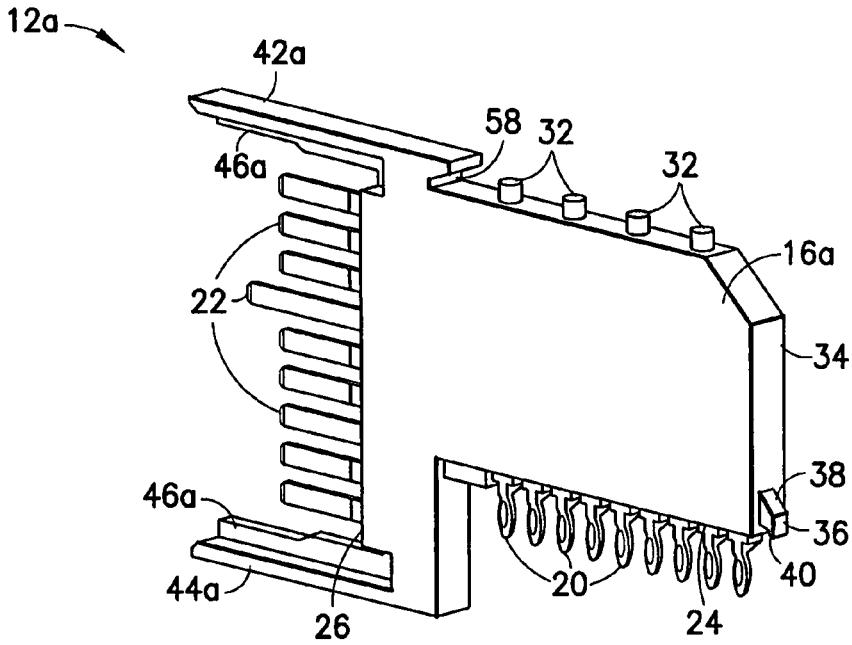
FIG. 4 is a perspective view of the first connector module shown in FIG. 3.
Figure 5:
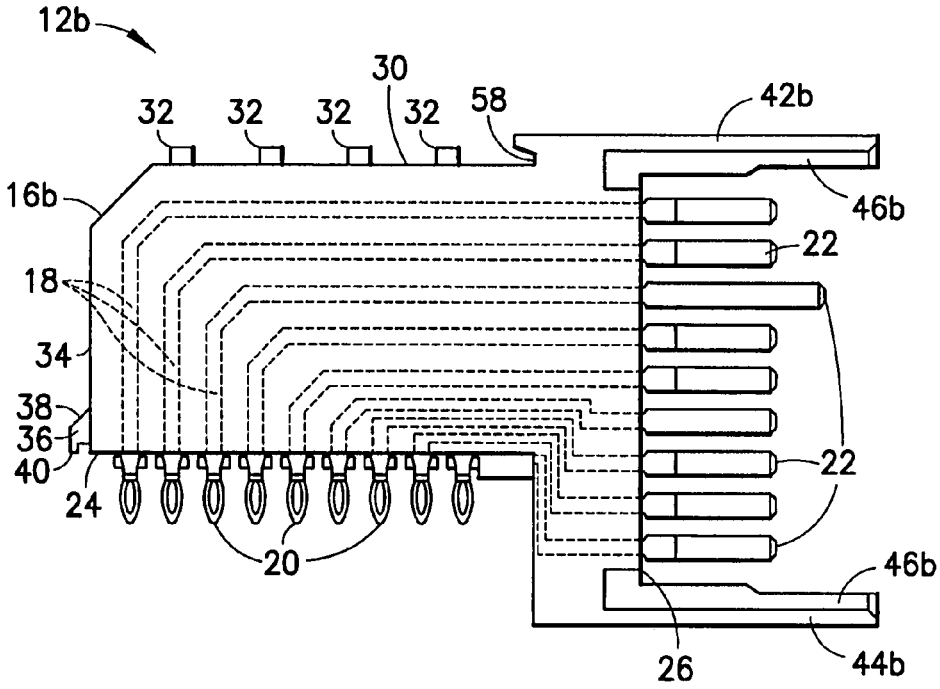
FIG. 5 is a side view of a second connector module used in the connector shown in FIG. 1.
Figure 6:
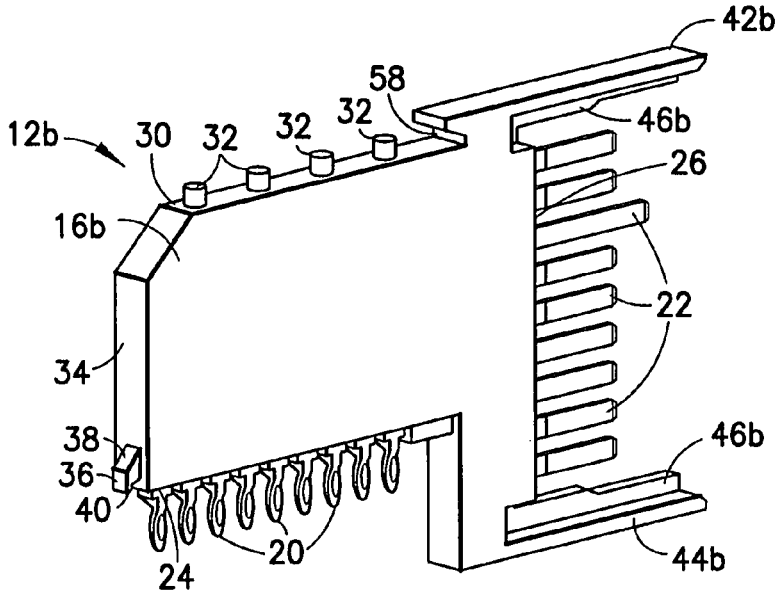
FIG. 6 is a perspective view of the second connector module shown in FIG. 5.

FIGS. 1 and 2 illustrate perspective and side views, respectively, of the backplane connector 10 in accordance with a first embodiment of the present invention. The backplane connector 10 includes a plurality of connector modules 12*a*, 12*b* and a connector module retainer 14. The connector modules 12*a*, 12*b* are fixedly disposed adjacent to one another and supported by the connector module retainer 14. Each of the connector modules 12*a*, 12*b* may be an Insert Molded Leadframe Assembly (IMLA) capable of performing electrically as a stand-alone unit. Additionally, each of the connector modules 12*a*, 12*b* may transmit differential pair or single ended signals.

Figure 15:
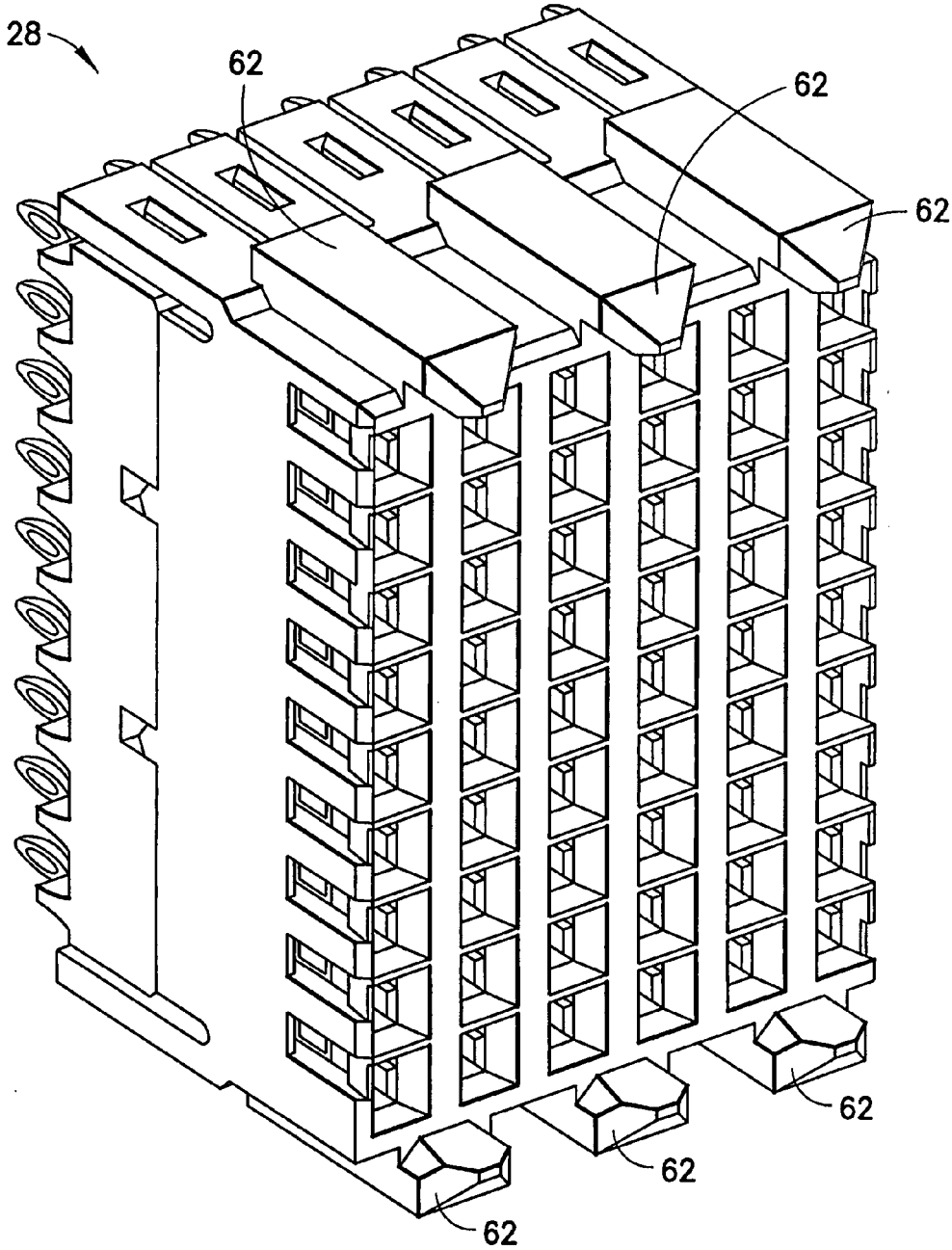
FIG. 15 is a perspective view of a mating electrical connector.

The connector modules 12*a*, 12*b*, which may also be individually referred to as a first connector module 12*a* and a second connector module 12*b*, are further illustrated in FIGS. 3-6. Each of the connector modules 12*a*, 12*b* comprises leadframe assemblies 16*a*, 16*b*, respectively, and a plurality of electrically conductive contacts 18. The leadframe assemblies 16*a*, 16*b*, which may be fabricated from a dielectric material such as plastic for example, support the contacts in a column configuration. Each of the contacts has a terminal end 20 and a mating end 22. The terminal ends 20 extend from a terminal side 24 and are configured to engage with a printed circuit board or other electronic device (not shown). The mating ends 22 extend from a mating side 26 and are configured to engage with a mating electrical connector 28 (shown in FIG. 15).

Each of the leadframe assemblies 16*a*, 16*b* further comprises a first side 30. The first side 30 is opposite the terminal side 24. The first side 30 comprises a plurality of first projecting members 32. It is to be understood that although the figures illustrate four first projecting members 32 per connector module 12*a*, 12*b*, the connector modules 12*a*, 12*b* may comprise any number of first projecting members 32. Additionally, although the figures illustrate the first projecting members 32 as cylindrically shaped members, any suitable shape for providing alignment of the retainer is envisioned.

Figure 9:
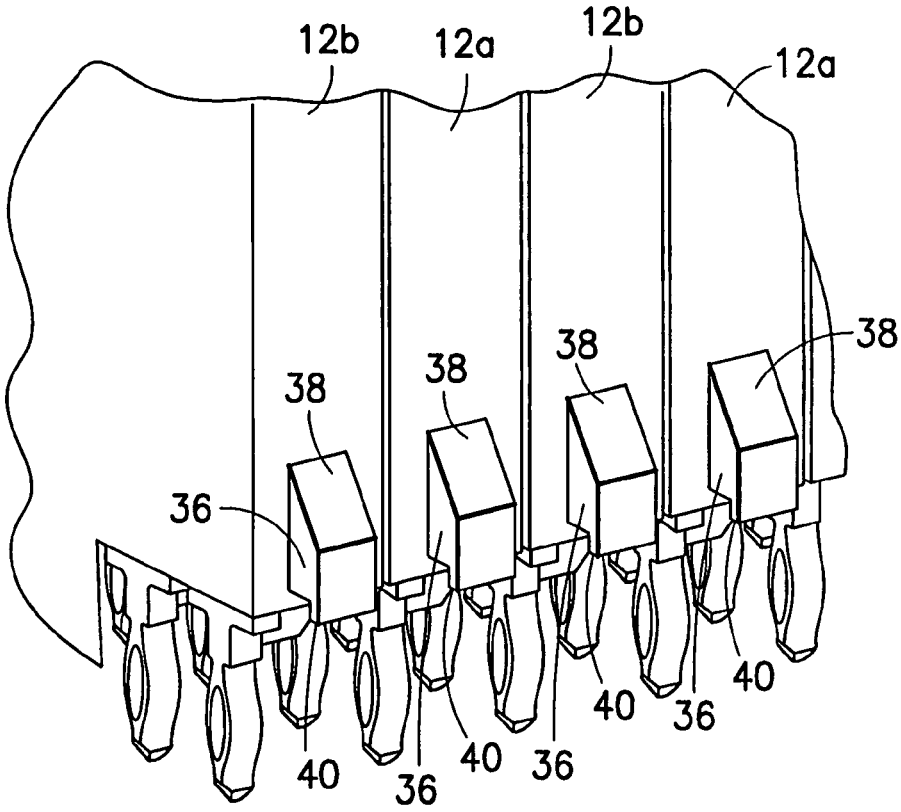
FIG. 9 is an enlarged view of a portion of the adjacently disposed connector modules shown in FIG. 8.

Each of the leadframe assemblies 16*a*, 16*b* also comprises a second side 34. The second side 34 is opposite the mating side 26. The second side 34 comprises at least one second projecting member 36. The second projecting member 36 may be a generally rectangular shaped member. The second projecting member may also further comprise a "ramp" or chamfered edge 38 and an extending lip portion 40 (best illustrated in FIG. 9). It should be understood that although the figures illustrate the second projecting members 36 as generally rectangular shaped members, any suitable shape for providing a snap-fit is envisioned. Additionally, although the figures illustrate the "ramp" or chamfered edge 38 facing in a direction towards the first side 30, alternative embodiments may have a "ramp" or chamfered edge 38 facing other directions. Further, although the figures illustrate the lip portion 40 extending in a direction towards the terminal side 24, a lip portion 40 extending in any direction is envisioned.

The first leadframe assembly 16*a* further comprises a first mating member 42*a* and a second mating member 44*a*. The first mating member 42*a* extends from the mating side 26 proximate the first side 30. The second mating member 44*a* extends from the mating side 26 proximate the terminal side 24. The mating members 42*a*, 44*a* extend beyond, and are substantially parallel to, the mating ends 22 in a general cantilevered fashion. The first mating member 42*a* and the second mating member 44*a* each comprise a recessed portion 46*a* which extends from the mating side 26 and extends along the length of the mating member 42*a*, 44*a*. The recessed portions 46*a* of leadframe assembly 16*a* are configured to face similar recessed portions of leadframe assembly 16*b*.

The second leadframe assembly 16*b* also comprises a first mating member 42*b* and a second mating member 44*b*. The first mating member 42*b* extends from the mating side 26 proximate the first side 30. The second mating member 44*b* extends from the mating side 26 proximate the terminal side 24. The mating members 42*b*, 44*b* extend beyond, and are substantially parallel to, the mating ends 22 in a general cantilevered fashion. The first mating member 42*b* and the second mating member 44*b* each comprise a recessed portion 46*b* which extends from the mating side 26 and extends along the length of the mating member 42*b*, 44*b*. The recessed portions 46*b* of leadframe 16*b* are configured to face the similar recessed portion 46*a* of leadframe 16*a*.

The recessed portions 46*a*, 46*b* may be formed by a molding process used to fabricate the leadframe assemblies 16*a*, 16*b*, or any by other suitable methods.

Figure 7:
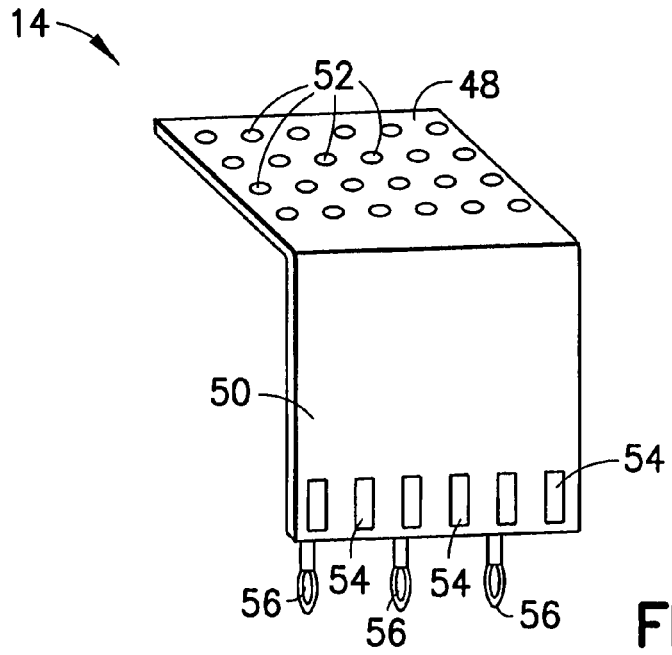
FIG. 7 is a perspective view of a connector module retainer used in the connector shown in FIG. 1.

Referring now to FIG. 7, the connector module retainer (or leadframe assembly retainer) 14 includes a first extending portion 48 and a second extending portion 50. The first extending portion 48 comprises a plurality of first openings 52 configured to receive the first projecting members 32. The second extending portion 50 is substantially perpendicular to the first extending portion 48. The second extending portion 50 comprises a plurality of second openings 54 configured to receive the second projecting members 36. The connector module retainer 14 functions as an organizer for the connector modules 12*a*, 12*b* and may be formed from metal by a stamping process. The retainer may be made from a thin material, or may be made thick enough to withstand flat rock insertion.

It is to be understood that although the figures illustrate the first openings 52 as cylindrically shaped and the second openings 54 as generally rectangular shaped, any suitable shape for providing a press-fit or snap-fit, respectively, is envisioned.

The connector module retainer 14 may further comprise one or more contact sections 56. The contact sections 56 may extend from the second extending portion 50 and be configured to be connected to an electrical component, such as a printed circuit board ground plane for example. Connecting the connector module retainer 14 in this manner allows the connector module retainer 14 to act as an electromagnetic interference (EMI) shield. It should be understood that although the figures show the connector module retainer 14 as having three contact sections 56, alternative embodiments may have any number of contact sections 56.

Figure 8:
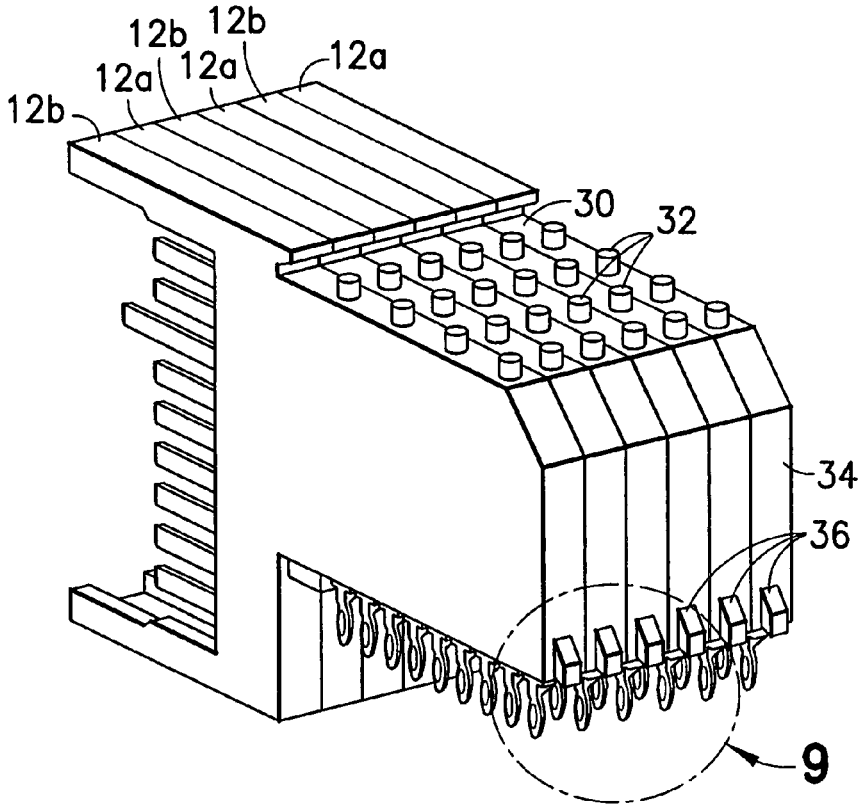
FIG. 8 is a perspective view of adjacently disposed connector modules of FIGS. 4 and 6.
Figure 10:
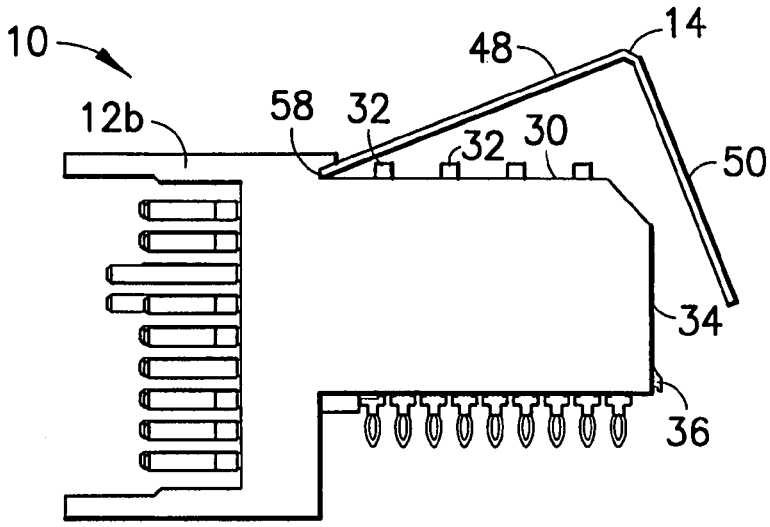
FIG. 10 is a side view of the adjacently disposed connector modules shown in FIG. 8 with a partially installed connector module retainer of FIG. 7.
Figure 11:
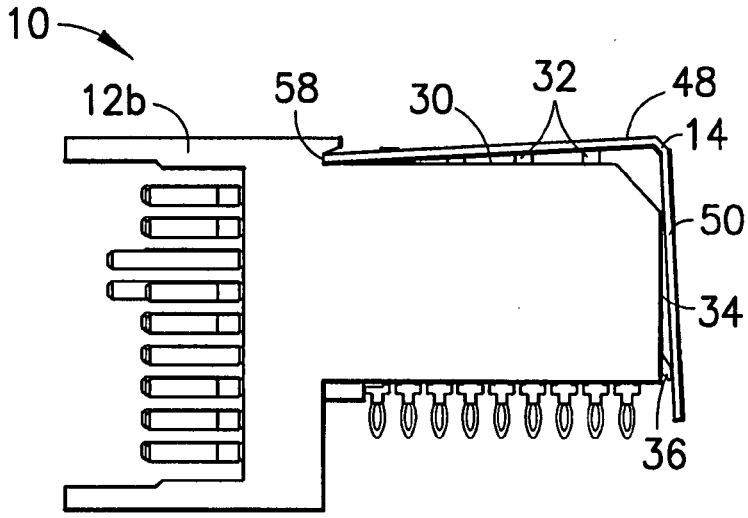
FIG. 11 is a side view of the adjacently disposed connector modules shown in FIG. 8, with the connector module retainer in a partially installed orientation, with partially engaged first projecting members.
Figure 12:
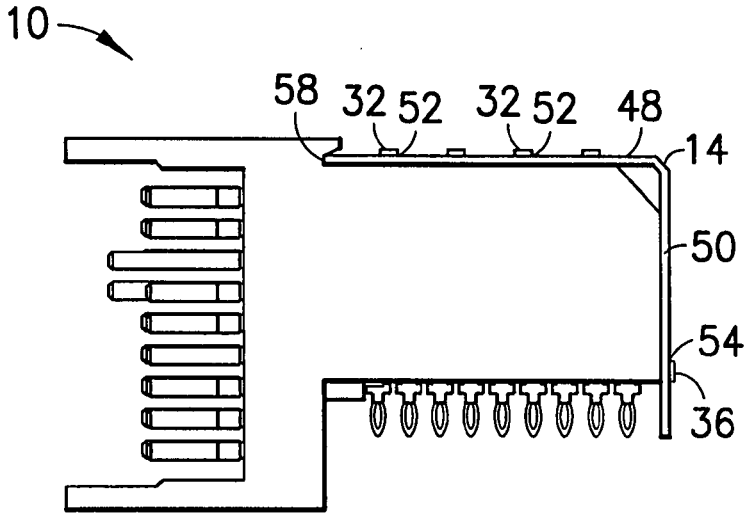
FIG. 12 is a side view of the adjacently disposed connector modules shown in FIG. 8 with the connector module retainer in a fully installed orientation.
Figure 13:
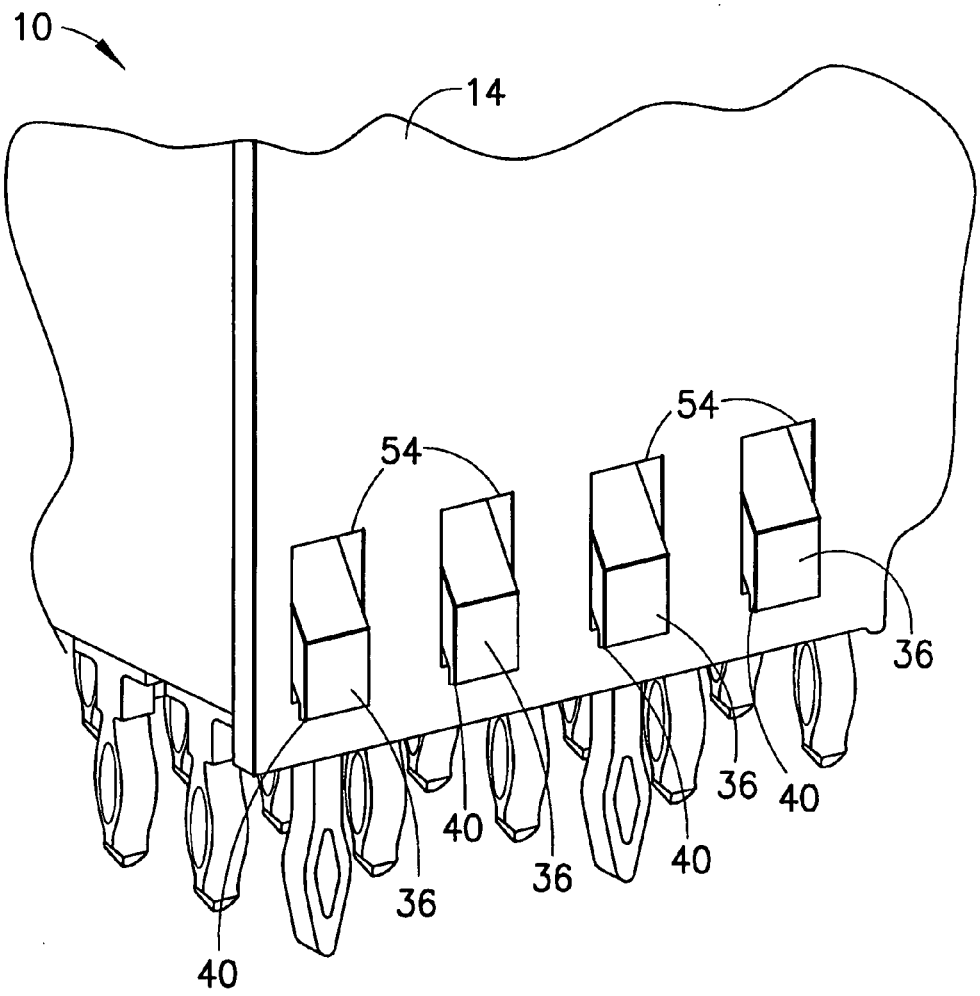
FIG. 13 is an enlarged perspective view of a portion of the backplane connector of FIG. 1.

The connector module retainer attaches to the first side 30 and the second side 34 of the adjacently disposed connector modules 12*a*, 12*b* illustrated in FIG. 8. The first projecting members 32 and the second projecting members 36 (best illustrated in FIG. 9) are aligned complementary to the arrangement of the openings 52, 54 in the connector module retainer 14. To attach the connector module retainer 14, a free end of the first extending portion 48 of the connector module retainer may be inserted into a recessed edge 58 (best illustrated in FIGS. 3-6) of the first side 30 as shown in FIG. 10. The recessed edge 58 helps maintain alignment of the retainer 14 to the projections 32, 36 as it is fitted over the connector modules 12*a*, 12*b*. As shown in FIG. 11 the retainer 14 is then lowered or rotated in place, in a direction towards the terminal side 24. The first projecting members 32 and the second projecting members 36 function as retention features for the connector module retainer 14. As the first extending portion 48 comes into contact with the first side 30, the first projecting members 32 fit to the first openings 52 (see FIG. 12). As the second extending portion 50 comes into contact with the second side 34, the second openings snap-fit over the lip portion 40 of the second projecting members 36 (see FIGS. 12 and 13). As shown in FIG. 12, the leadframe assemblies 16*a*, 16*b* may have cut-outs in the corners. This gives the retainer 14 clearance to deflect so that the retainer 14 can snap over the retention features.

Figure 14:
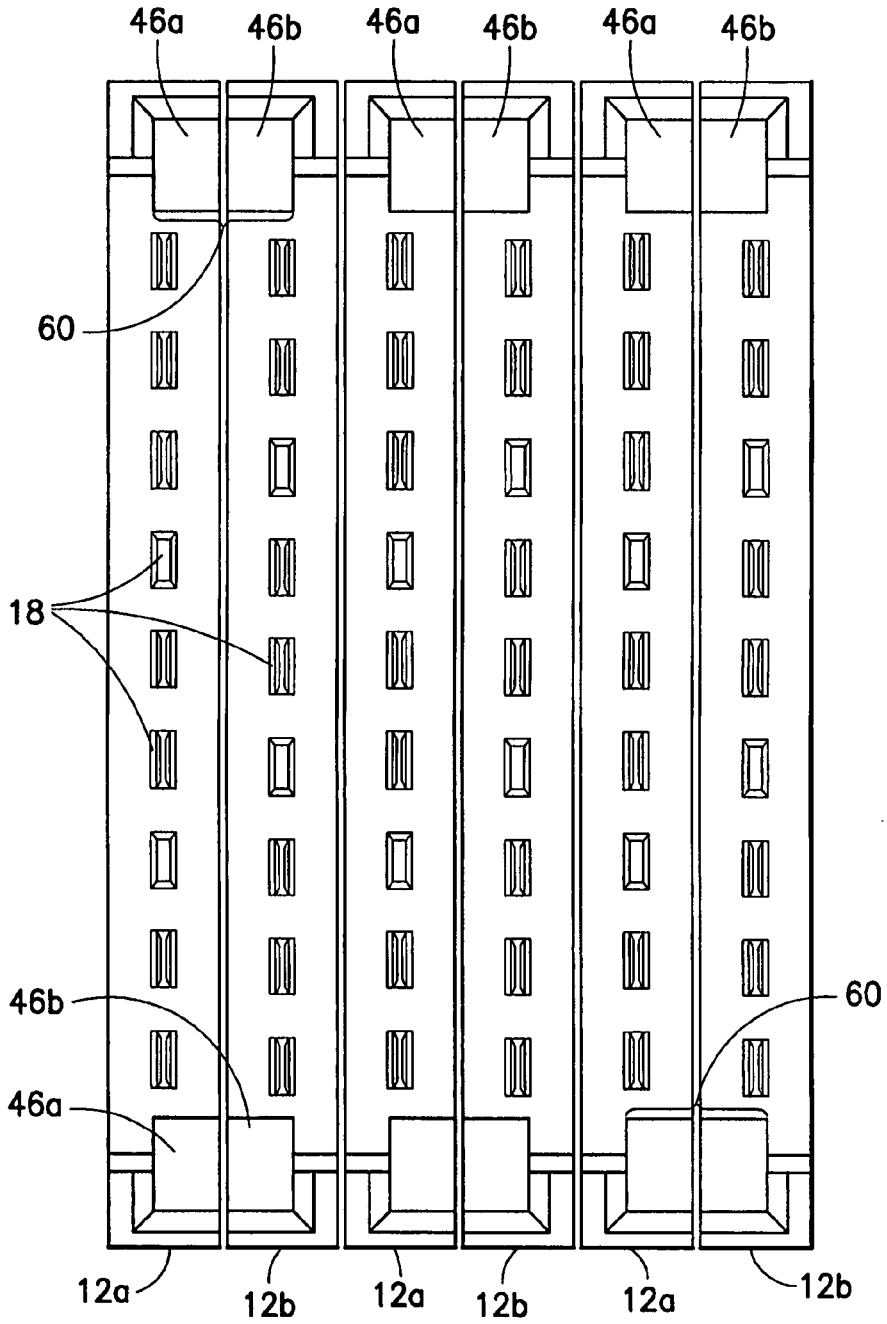
FIG. 14 is a front view of the backplane connector of FIG. 1.
Figure 16:
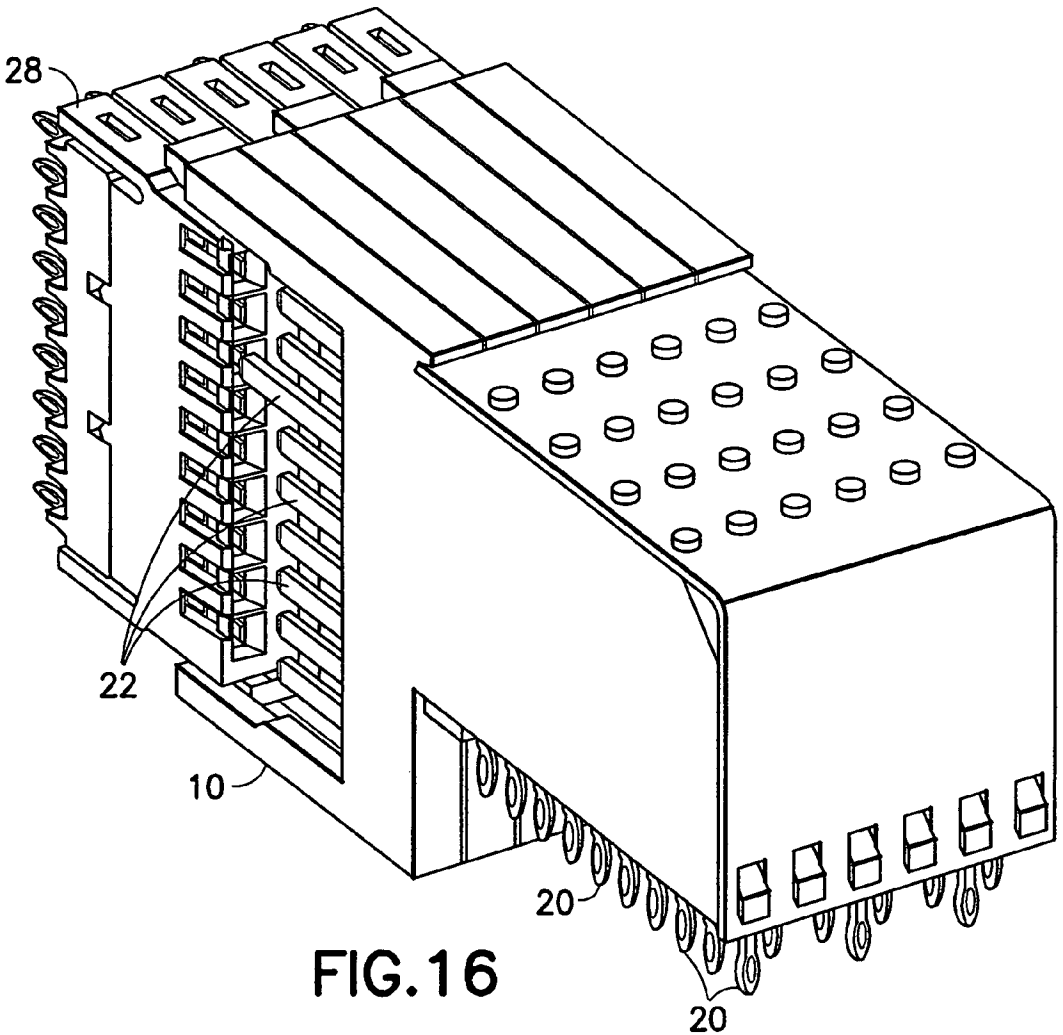
FIG. 16 is a perspective view of the backplane connector of FIG. 1 partially engaged with the mating electrical connector of FIG. 15.

The connector module retainer 14 secures the connector modules 12*a*, 12*b* adjacent to one another to form the backplane connector 10. The connector modules 12*a*, 12*b* are aligned such that the first connector modules 12*a* are adjacent to the second connector modules 12*b* and the recessed portions 46*a*, 46*b* are facing each other. The pairs of facing recessed portions 46*a*, 46*b* combine to form a plurality of slots 60 (see FIG. 14) configured to receive a plurality of guide posts 62 from a mating electrical connector 28 (see FIGS. 15 and 16). The guide posts 62 may be configured to fit between the adjacent columns of contacts 18. The width of each of the slots 60 is greater than a width of each of the recessed portions 46*a*, 46*b*. And preferably, the width of each slot 60 is about double the width of each of the recessed portions 46*a*, 46*b*. The connector module retainer 14 fixedly disposes the connector modules 12*a*, 12*b* adjacent one another. The connector module retainer 14 secures the modules 12*a*, 12*b* substantially parallel to one another without the need for a separate housing. This reduces cost by eliminating the need for a separate housing.

The guide posts 62 and the slots 60 allow for a mating alignment prior to electrical connection by the mating ends 22. The connector module retainer 14 also provides for a connection to an electrical component, such as a printed circuit board (not shown) for example. The connector module retainer aligns the terminal ends 20 for press-fitting to the printed circuit board. Additionally, during press-fit application to a printed circuit board, the first projecting members 32 may deform (similar to conventional rivets) which further increases the rigidity of the backplane connector 10. It should be understood that although the figures illustrate six recessed portions 46*a*, 46*b* forming three slots 60 (per side), alternative embodiments having any number of recessed portions 46*a*, 46*b* or slots 60 may be provided. Further, although the figures illustrate pairs of guide posts 62 insertable between two columns of contacts 18, other configurations are envisioned.

Additionally, it should be understood that although the figures show nine contacts 18 per connector module 12*a*, 12*b* and six connector modules 12*a*, 12*b* per connector 10, any number of contacts 18 or connector modules 12*a*, 12*b* may be provided.

Figure 17:
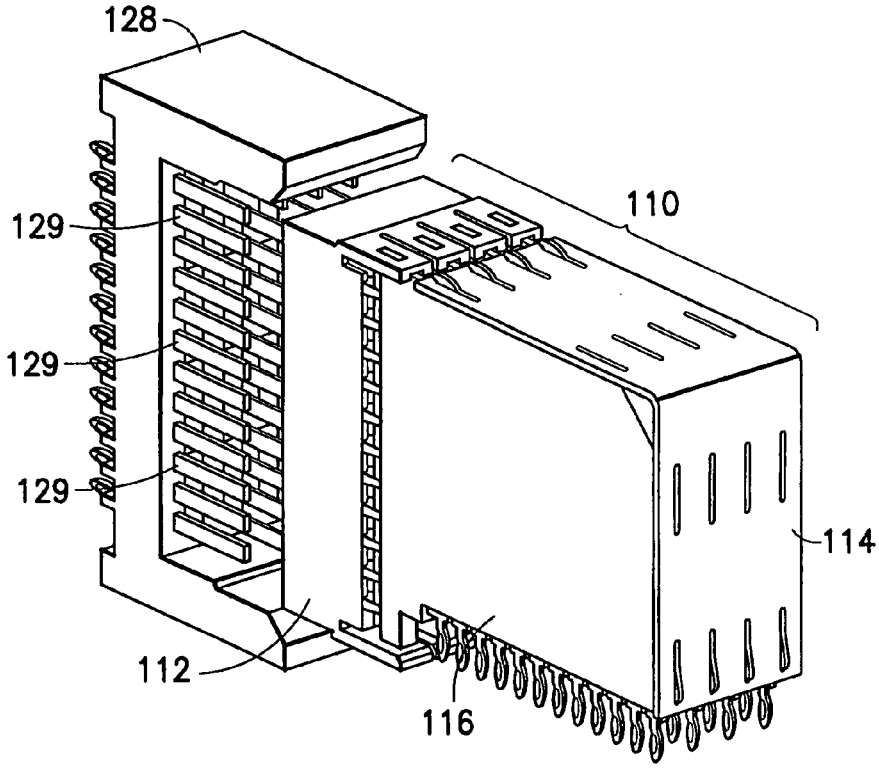
FIG. 17 is a perspective view of an alternative backplane connector partially engaged with a mating electrical connector.
Figure 18:
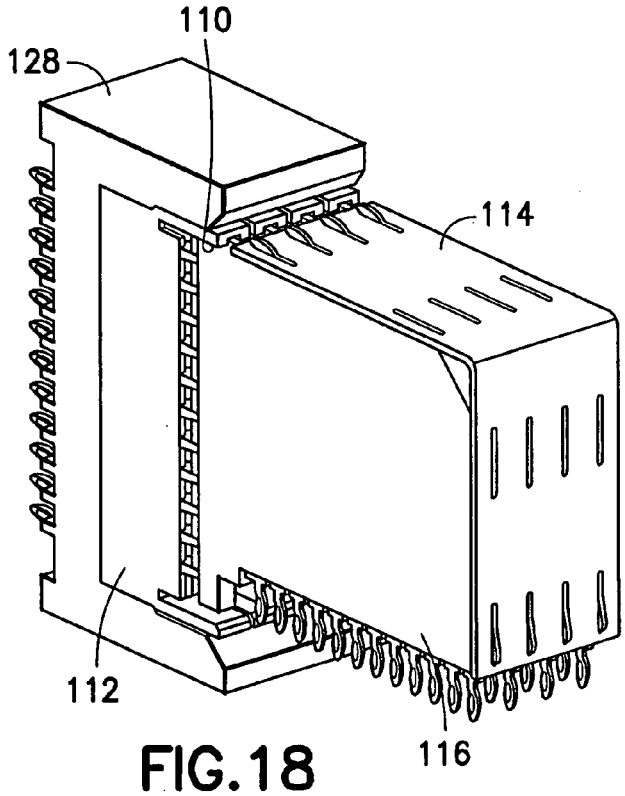
FIG. 18 is a perspective view of the alternative backplane connector shown in FIG. 17 fully engaged with the mating electrical connector shown in FIG. 17.

Referring now to FIGS. 17 and 18, there are shown perspective views of a backplane connector 110 in accordance with a second embodiment of the present invention. The backplane connector 110 is similar to the backplane connector 10. The backplane connector 110 is configured to connect with a mating electrical connector 128.

The backplane connector 110, which may be a daughter-card receptacle connector for example, includes a connector module unit (or housing) 112, a retainer 114, and a plurality of leadframe assemblies 116. The leadframe assemblies 116 are fixedly disposed adjacent to one another and supported by the retainer 114. The connector module unit 112 receives the plurality of leadframe assemblies 116 and provides for an electrical connection between the leadframe assemblies 116 and the mating electrical connector 128, which may be a vertical header for example.

Each of the leadframe assemblies 116 may be an Insert Molded Leadframe Assembly (IMLA) capable of performing electrically as a stand-alone unit. Additionally, each of the leadframe assemblies 116 may transmit differential pair or single ended signals. It should further be understood that the backplane connector 110 may include, for example, high-speed, shieldless electrical connectors that operate below 1 Gigabit/sec, at 1 Gigabit/sec, and above 1 Gigabit/sec (1 Gigabit/sec to 20+ Gigabits/sec) with less than 6% worst case, multi-active crosstalk. The backplane connector 110 is shieldless at a 40 picosecond rise time/10 Gigabits/sec data transfer rate. Rise times can be 1000 to 35 picoseconds.

Impedance is matched to a system impedance, such as 85 to 100 Ohms, plus or minus 10 percent, without shields.

Figure 19:
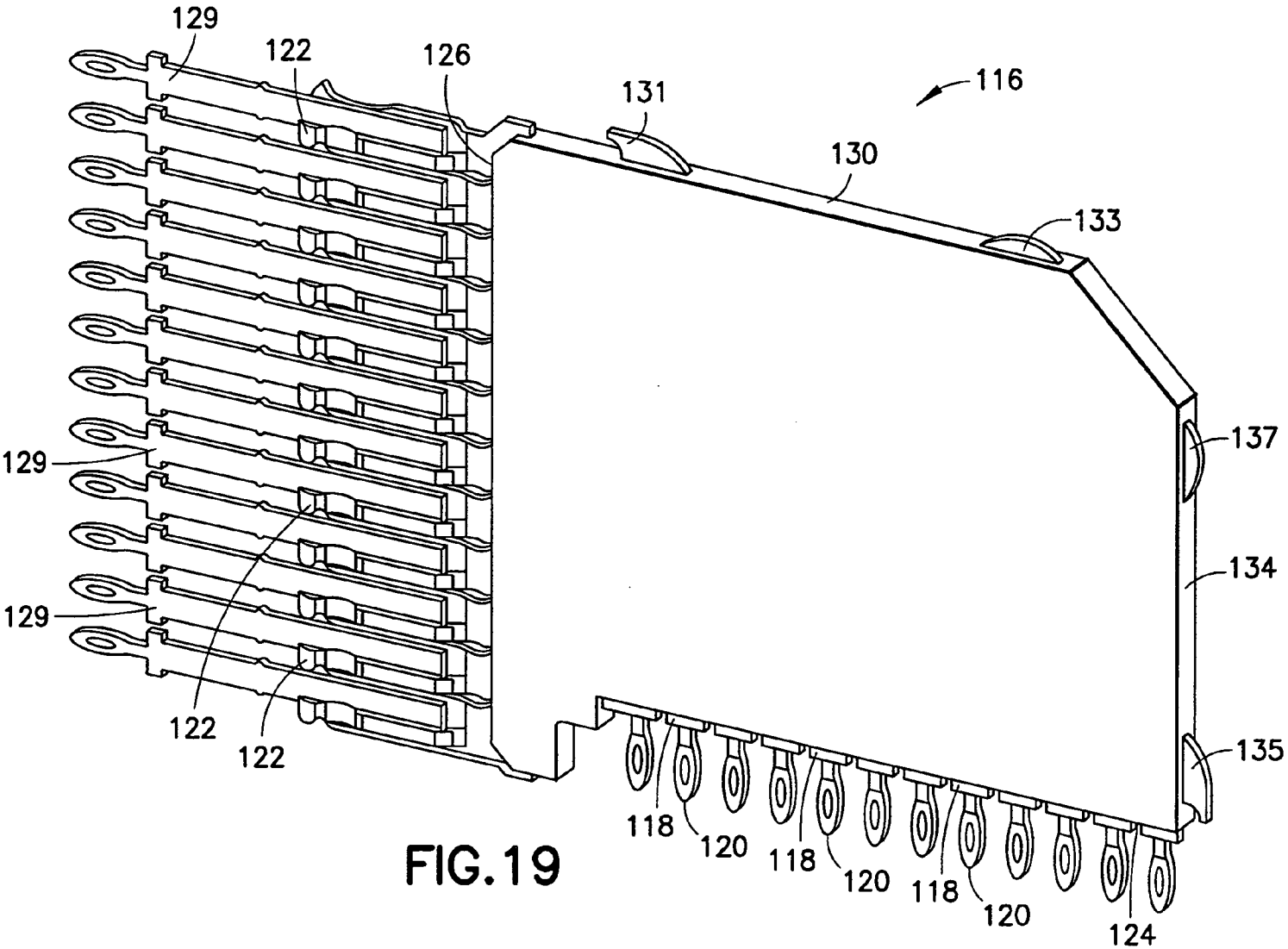
FIG. 19 is a perspective view of an alternative leadframe assembly used in the connector shown in FIG. 17.

Referring also to FIG. 19, each of the leadframe assemblies 116 supports a plurality of electrically conductive contacts 118 as described above for the first embodiment. Each of the contacts 118 has a terminal end 120 and a mating end 122. The terminal ends 120 extend from a terminal side 124 (opposite a first side 130) and are configured to engage with a printed circuit board or other electronic device (not shown). The mating ends 122 extend from a mating side 126 (opposite a second side 134) and are configured to engage with the connector module unit 112 (shown in FIGS. 17 and 18). The mating ends 122 of the electrical contacts jog in alternating, opposite directions. This helps with assembly and balances normal forces and helps with crosstalk. The contacts 118 may have a material thickness of about 0.1 mm to 0.4 mm (0.2 mm preferred), with a height of about 0.2 mm to 0.8 mm. Column spacing between adjacent lead frame assemblies 116, or IMLAs/modules, is around 1.0 mm to 2 mm or more, with 1.6 mm preferred. FIG. 19 shows contacts (or contact blades) 129 of the mating electrical connector 128 shown connected to the mating ends 122 for illustrative purposes only.

The first side 130 of each of the leadframe assemblies 116 comprises a plurality of first projecting members. One difference between the leadframe assemblies 116 and the leadframe assemblies 16*a*, 16*b* is that one of the plurality of first projecting members of the leadframe assemblies 116 may be a first hook 131 and another of the plurality of first projecting members of the leadframe assemblies 116 may be a first alignment feature 133. The first hook 131 is disposed proximate the mating side 126. The first alignment feature 133 is disposed proximate the second side 134.

The second side 134 of each of the leadframe assemblies 116 comprises a plurality of second projecting members. Similar to the first projecting members on the first side 130, the second projecting members on the second side 134 may be a second hook 135 and a second alignment feature 137. The second hook 135 and the second alignment feature 137 are disposed in a generally opposite orientation to that of the first hook 131 and the first alignment feature 133. The second hook 135 is disposed proximate the terminal side 124. The second alignment feature 137 is disposed proximate the first side 130.

The first hooks 131 and the second hooks 135 engage opposite ends of the retainer 114. The first alignment features 133 and the second alignment features 137 help maintain the leadframe assemblies 116 straight and aligned between the first hooks 131 and the second hooks 135. The alignment features 133, 137 also provide for ease of assembly during installation of the retainer 114 to the leadframe assemblies 116.

Figure 20:
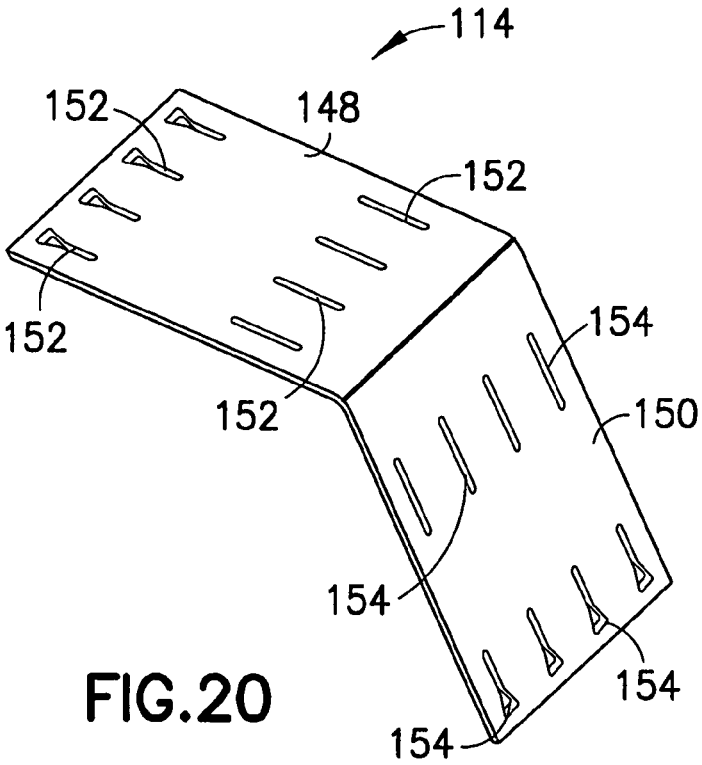
FIG. 20 is a perspective view of an alternative retainer used in the connector shown in FIG. 17.

Referring now to FIG. 20, the retainer (or shield) 114 includes a first extending portion 148 and a second extending portion 150. The first extending portion 148 comprises a plurality of first openings 152 configured to receive the first hooks 131 and the first alignment features 133. The second extending portion 150 is substantially perpendicular to the first extending portion 148. The second extending portion 150 comprises a plurality of second openings 154 configured to receive the second hooks 135 and the second alignment features 137. The retainer 114 functions as an organizer for the leadframe assemblies 116 and may be formed from metal by a stamping process. The retainer 114 may also function as an EMI shield. In an alternative embodiment, the retainer 114 may have split fingers that hold the first and second projecting members, or fins, on the leadframe assemblies 116. The retainer 114 can be electrically conductive, along the first and second projecting members, or fins, on the leadframe assemblies, or IMLAs, 116. This would provide for a contact section to be connected to an electrical component, such as a printed circuit board ground plane for example. Or, the retainer 114 and the first and second projecting members, or fins can be plastic, or any combination thereof. If the first and second projecting members, or fins, and the retainer 114 are conductive, the entire structure may be grounded. In addition, the leadframe assemblies, or IMLAs, 116 can have polarization features that mate with polarization holes in the retainer 114. This helps insure proper IMLA assembly.

Figure 21:
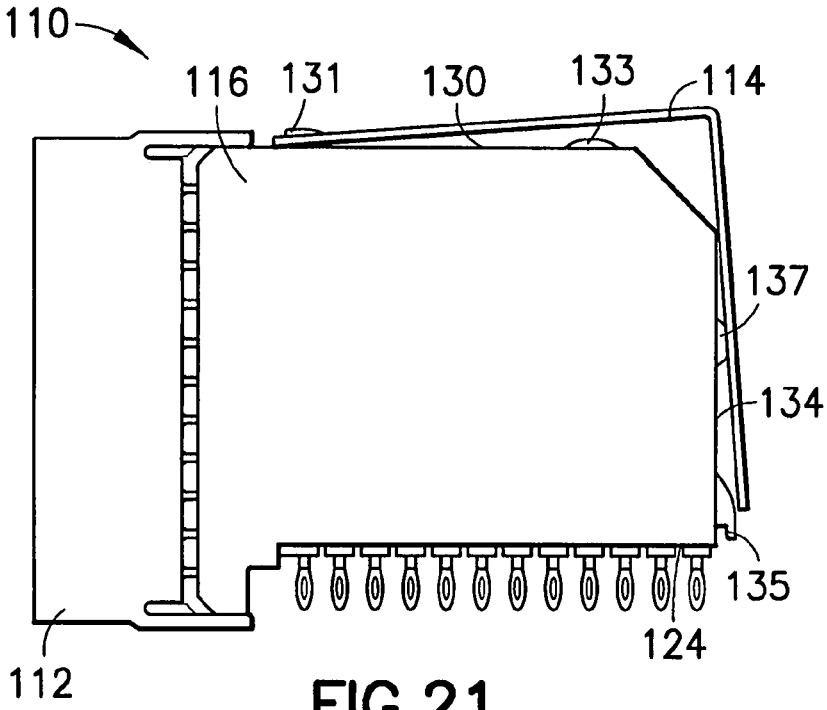
FIG. 21 is a side view of the alternative backplane connector shown in FIG. 17 with a partially installed alternative retainer of FIG. 20.
Figure 22:
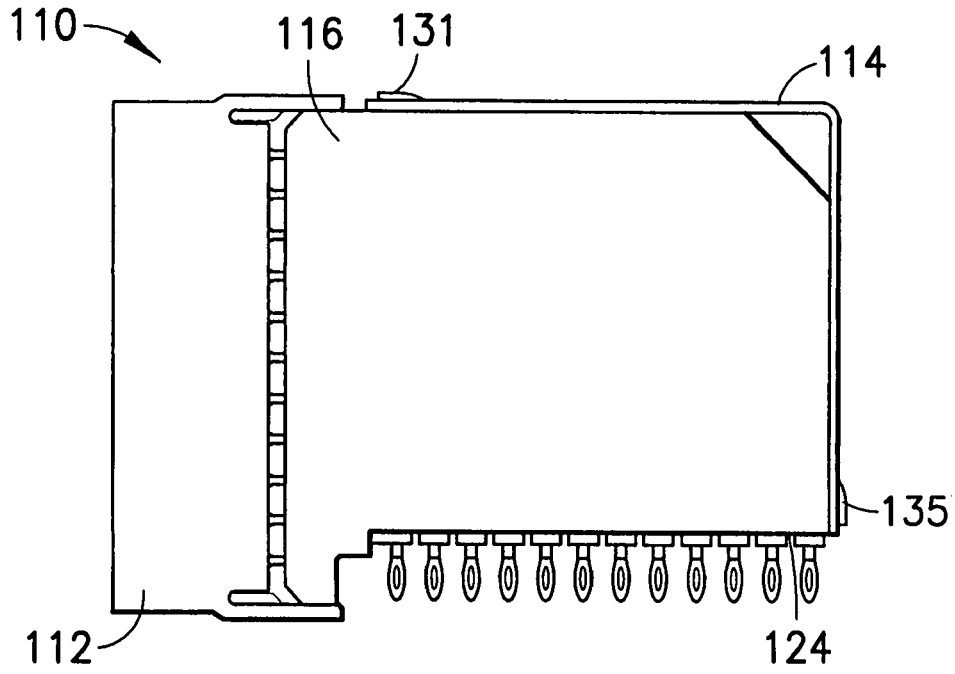
FIG. 22 is a side view of the alternative backplane connector shown in FIG. 17 with the alternative retainer of FIG. 20 in a fully installed orientation.

Referring now to FIGS. 21 and 22, the retainer 114 attaches to the first side 130 and the second side 134 of the adjacently disposed leadframe assemblies 116. The first hooks 131 and the first alignment features 133 and the second hooks 135 and the second alignment features 137 are aligned complementary to the arrangement of the openings 152, 154 in the retainer 114. To attach the retainer 114, the first hooks 131 are inserted into the corresponding first openings (or slots) 152 on the first extending portion 148 of the retainer 114 (as illustrated in FIG. 21). The first and second alignment features 133, 137 help maintain alignment of the retainer 114 to the first and second hooks 131, 135 as the retainer 114 is fitted over the leadframe assemblies 116. As shown in FIG. 22, the retainer 114 is then lowered (or rotated clockwise) in place, in a direction towards the terminal side 124. A corner section of the retainer 114 (between the first extending portion 148 and the second extending portion 150) may be deflected, by providing a downward force, to engage the second hook 135 with the corresponding second opening 154 on the second extending portion 150. After the force is removed, the retainer 114 will spring back up and will be retained to the leadframe assemblies 116. The first hooks 131 and the second hooks 135 function as retention features for the retainer 114. It is to be understood that the retainer 114 may alternatively be assembled by attaching first to the hook 135 and then to the hook 131.

The retainer 114 secures the leadframe assemblies 116 adjacent to one another as the leadframe assemblies 116 are received within the connector module unit 112 (see FIGS. 17 and 18) to form the backplane connector 110. An end of the connector module unit 112 comprises receptacles suitably sized and shaped to receive the contacts 129 from the mating connector 128.

The contacts 129 of the mating electrical connector, or header, 128 have material thickness/height in the same range as the contacts 118 of the leadframe assemblies 116. In one example, the row pitch of the contacts 129 is about 1 mm to 1.8 mm (1.2 mm preferred) and column pitch is about 1 mm to 2 mm, with 1.6 mm preferred.

It should be understood that although the contacts 118, 129 are arranged in an edge-to-edge arrangement along a column centerline in the header and receptacle, the two electrical contacts 118, 129 could be positioned broadside-to-broadside on opposite sides of a column centerline. It should also be understood that although the figures show twelve contacts 118 per leadframe assembly 116 and four leadframe assemblies 116 per connector 110, any number of contacts 118 or leadframe assemblies 116 may be provided.

Additionally, the header 128 may include pins or receptacle contacts, with the receptacle 110 including the opposite gender contacts. Furthermore, the receptacle 110 may also include a guide pin that minimizes the height of the connector system by keeping the guide pin height consistent with the header housing height.

Figure 23:
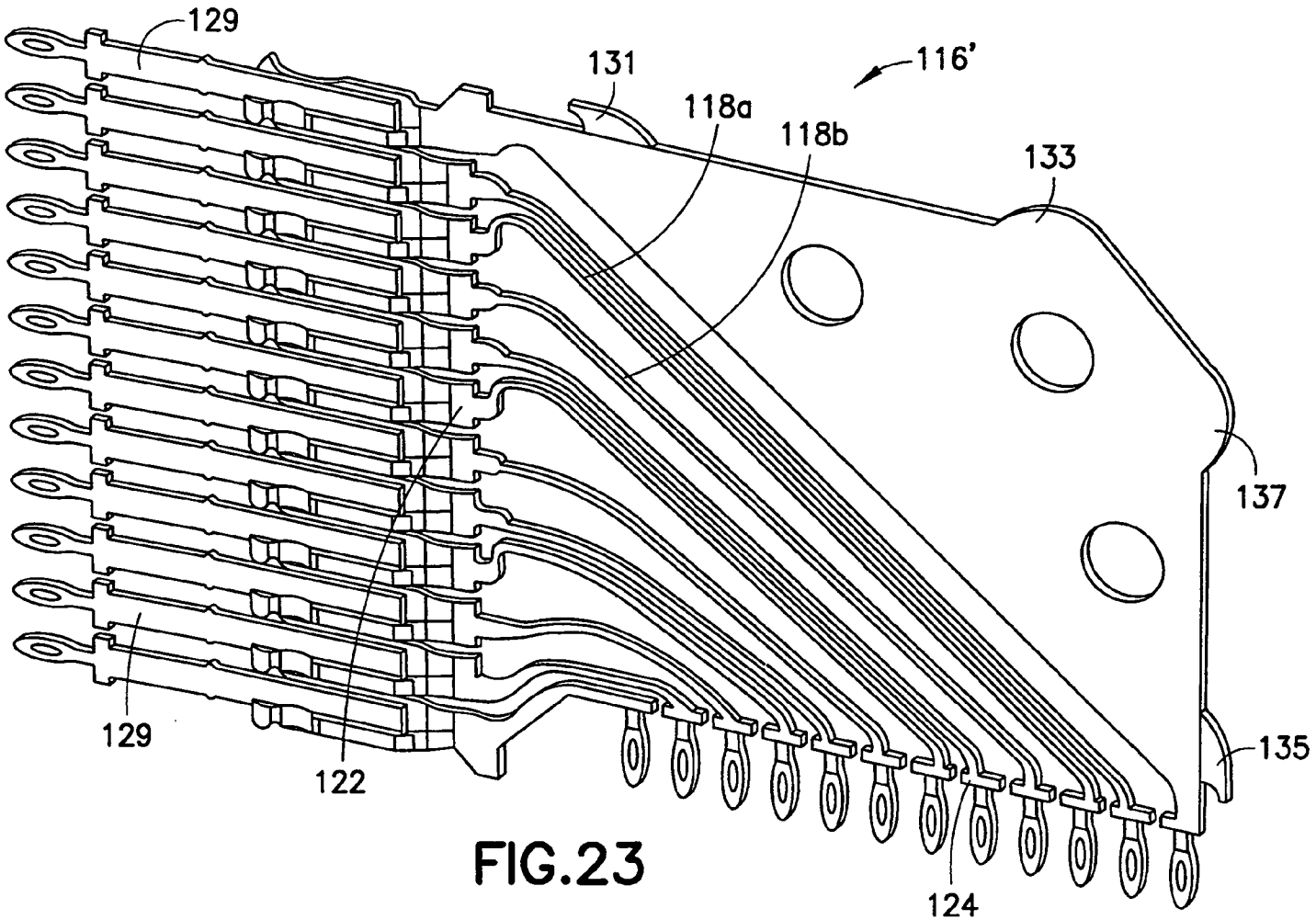
FIG. 23 is a perspective view of another alternative leadframe assembly used in the connector shown in FIG. 17.

Referring now to FIG. 23, there is shown a perspective view of a leadframe assembly 116' in accordance with a third embodiment of the present invention. FIG. 23 shows contacts (or contact blades) 129 of the mating electrical connector 128 shown connected to the mating ends 122 for illustrative purposes only. The leadframe assembly 116' is similar to the leadframe assembly 116 and similar features are similarly numbered. For clarity, the leadframe assembly 116' is shown without the surrounding dielectric material.

Figure 24:
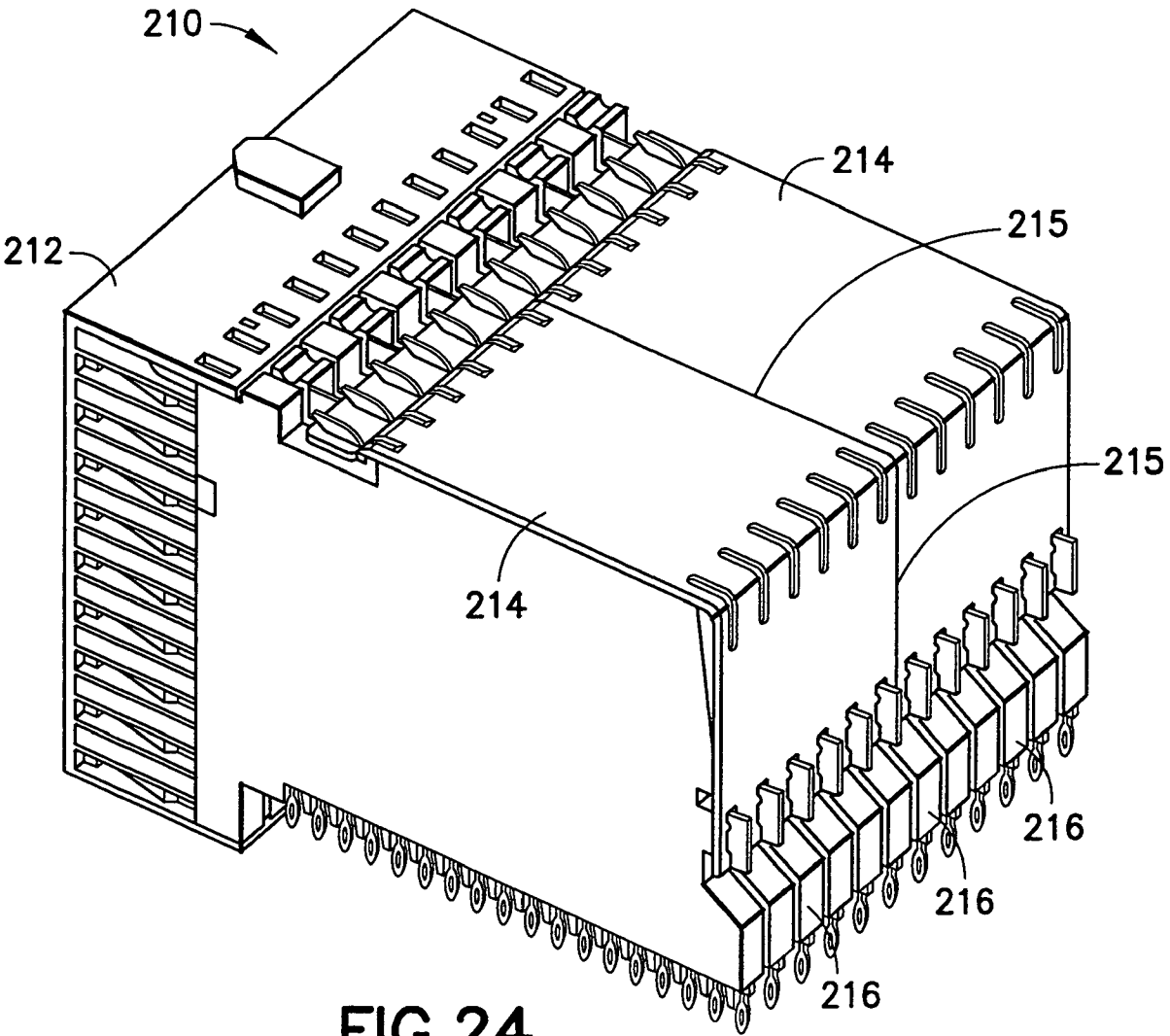
FIG. 24 is a perspective view of another alternative backplane connector.

Referring now to FIG. 24, there is shown a perspective view of a backplane connector 210 in accordance with a fourth embodiment of the present invention. The backplane connector 210 is similar to the backplane connectors 10, 110. The backplane connector 210 includes a connector module unit (or housing) 212, a retainer 214, and a plurality of leadframe assemblies 216. The leadframe assemblies 216 are fixedly disposed adjacent to one another and supported by the retainer 214. In one embodiment, the retainer 214 may be single one-piece integral member having a scored line section 215 at a middle portion of the retainer. The scored line section 215 provides an indentation or groove for facilitating separation of the retainer 214 at the scored line section 215. In another embodiment, the backplane connector may comprise two retainers 214 (wherein the line 215 represents adjacent edges of the adjacently disposed retainers 214). Each of the retainers 214 may organize a subassembly of the leadframe assemblies 216 for insertion into the connector module unit 212. The connector module unit 212 receives the plurality of leadframe assemblies 216 and provides for an electrical connection between the leadframe assemblies 216 and a mating electrical connector.

Figure 25:
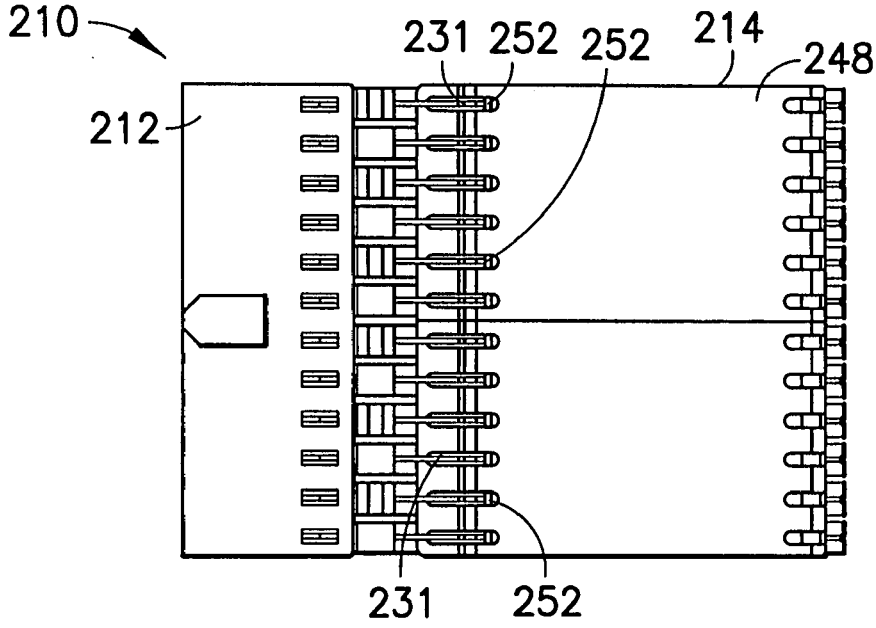
FIG. 25 is a top plan view of the alternative backplane connector shown in FIG. 24.
Figure 26:
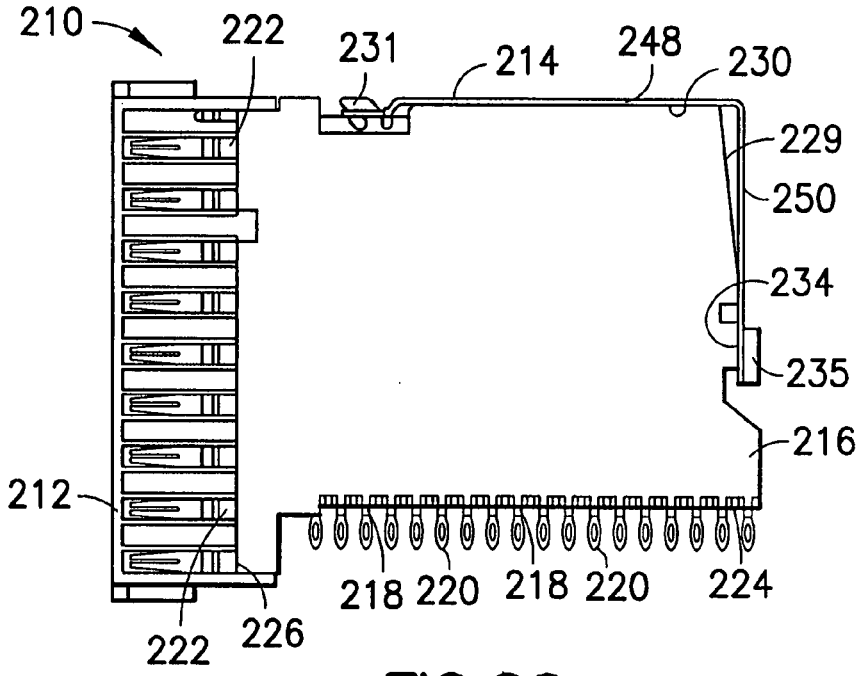
FIG. 26 is a side view of the alternative backplane connector shown in FIG. 24.
Figure 27:
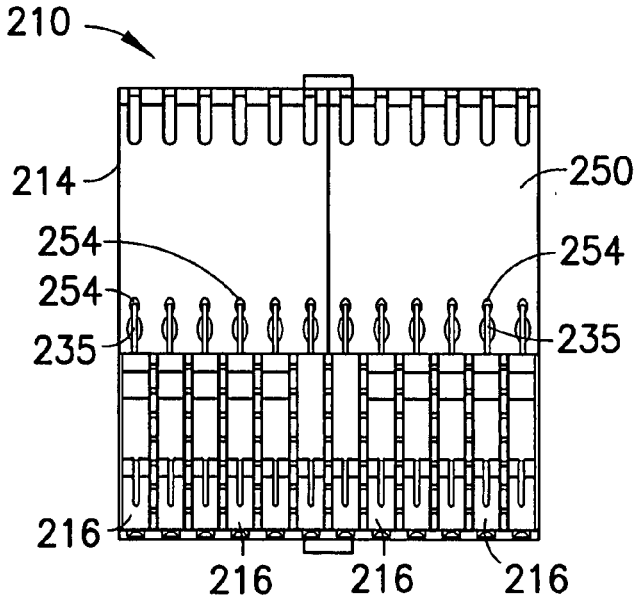
FIG. 27 is a front view of the alternative backplane connector shown in FIG. 24.

Referring also to FIGS. 25-27, each of the leadframe assemblies 216 supports a plurality of electrically conductive contacts 218 as described above for the previous embodiments. Each of the contacts 218 has a terminal end 220 and a mating end 222. The terminal ends 220 extend from a terminal side 224 (opposite a first side 230) and are configured to engage with a printed circuit board or other electronic device (not shown). The mating ends 222 extend from a mating side 226 (opposite a second side 234) and are configured to engage with the connector module unit 212.

The first side 230 of each of the leadframe assemblies 216 comprises a first projecting member. One difference between the leadframe assemblies 216 and the leadframe assemblies 16*a*, 16*b* is that the first projecting member of the leadframe assembly 216 may be a first latch 231. The first latch 231 is disposed proximate the mating side 226.

The second side 234 of each of the leadframe assemblies 216 comprises a second projecting member. The second projecting member on the second side 234 may be a second latch 235. The second latch 235 is disposed in a generally opposite orientation to that of the first latch 231. The second latch 235 is disposed proximate the terminal side 224. The lead frame assemblies 216 each further comprise an undercut region 229 which allows for shield deflection during assembly.

The retainer (or shield) 214 includes a first extending portion 248 and a second extending portion 250. The first extending portion 248 comprises a plurality of first openings 252 configured to receive the first latches 231. The second extending portion 250 is substantially perpendicular to the first extending portion 248. The second extending portion 250 comprises a plurality of second openings 254 configured to receive the second latches 235. The retainer 214 functions as an organizer for the leadframe assemblies 216 and may be formed from metal by a stamping process. The retainer 214 may also function as an EMI shield.

Figures 28, 29:
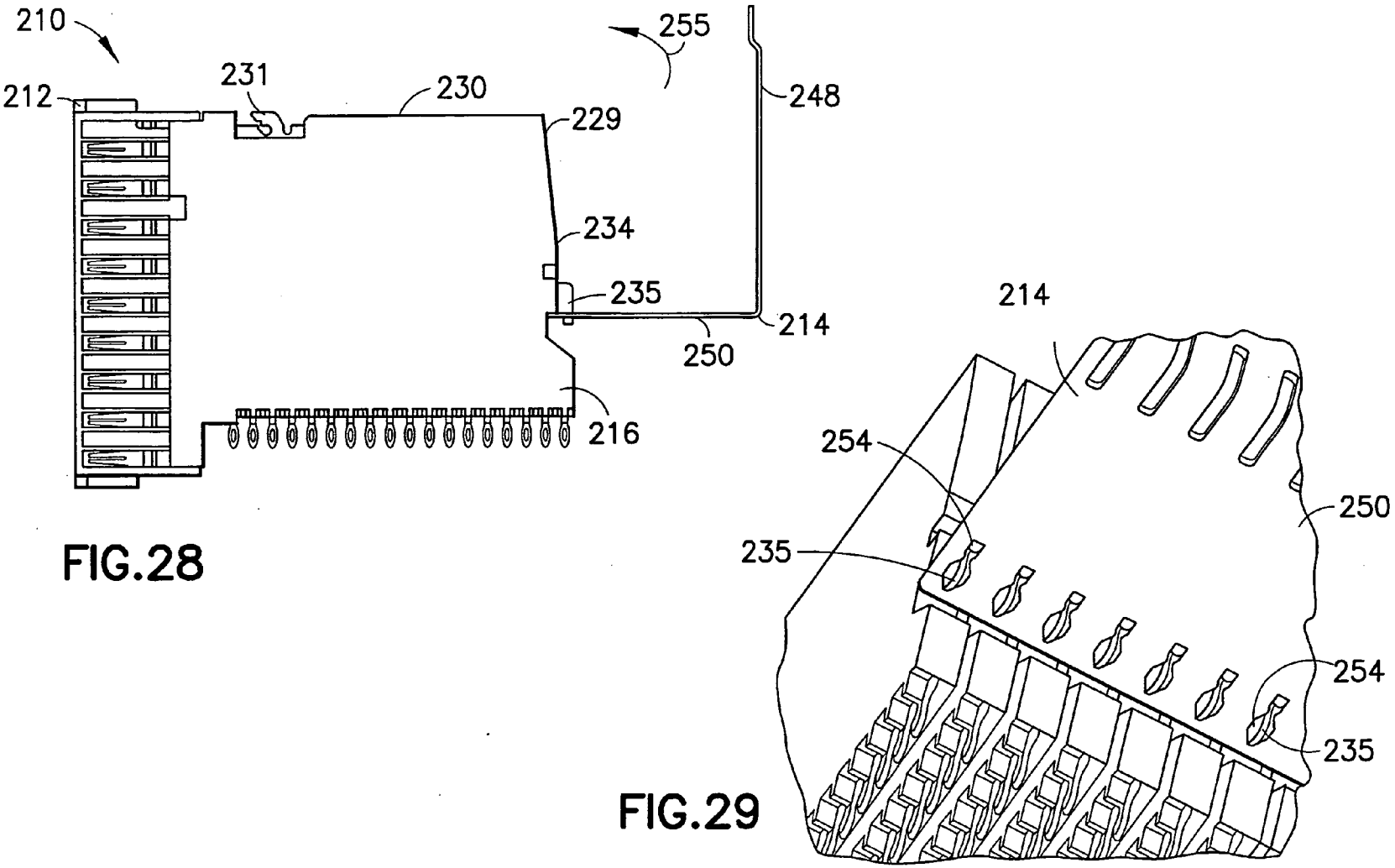
FIG. 28 is a side view of the alternative backplane connector shown in FIG. 24 with a partially installed connector module retainer.
FIG. 29 is an enlarged perspective view of the alternative backplane connector shown in FIG. 28.
Figure 30:
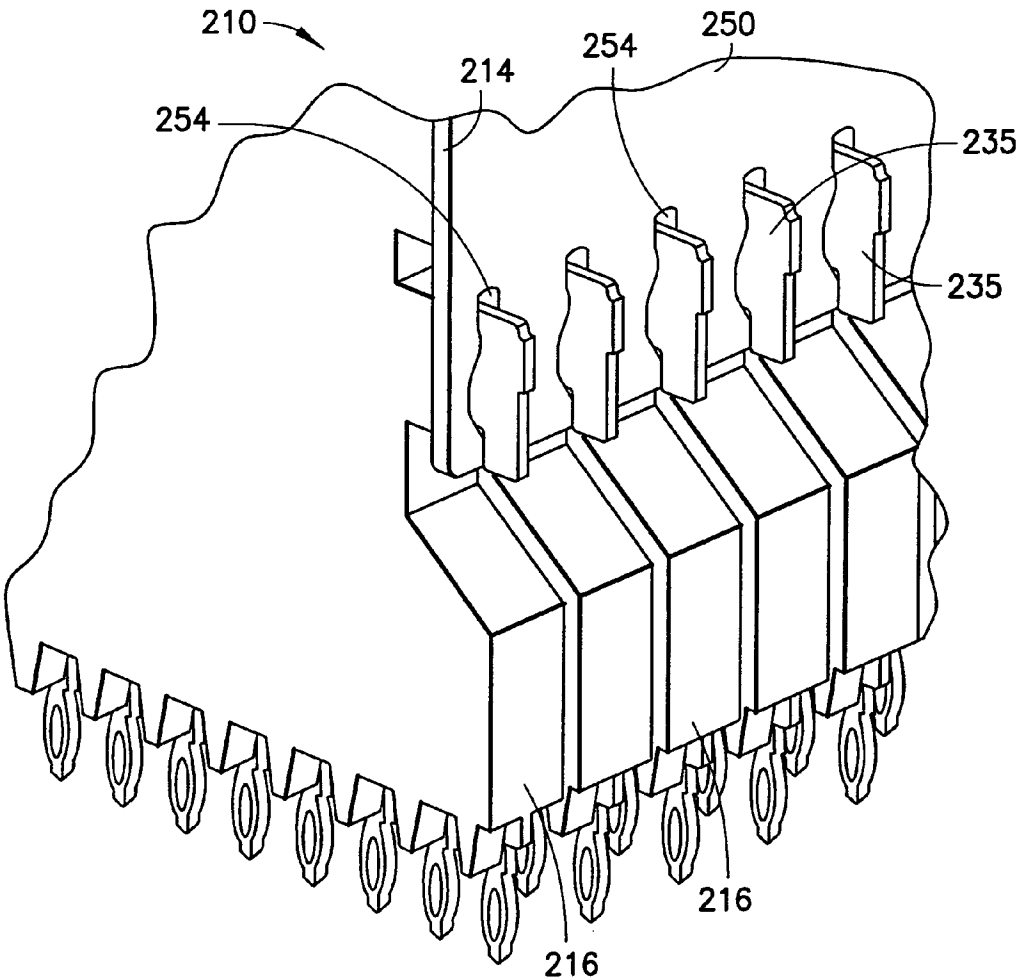
FIG. 30 is an enlarged perspective view of the alternative backplane connector shown in FIG. 24.
Figure 31:
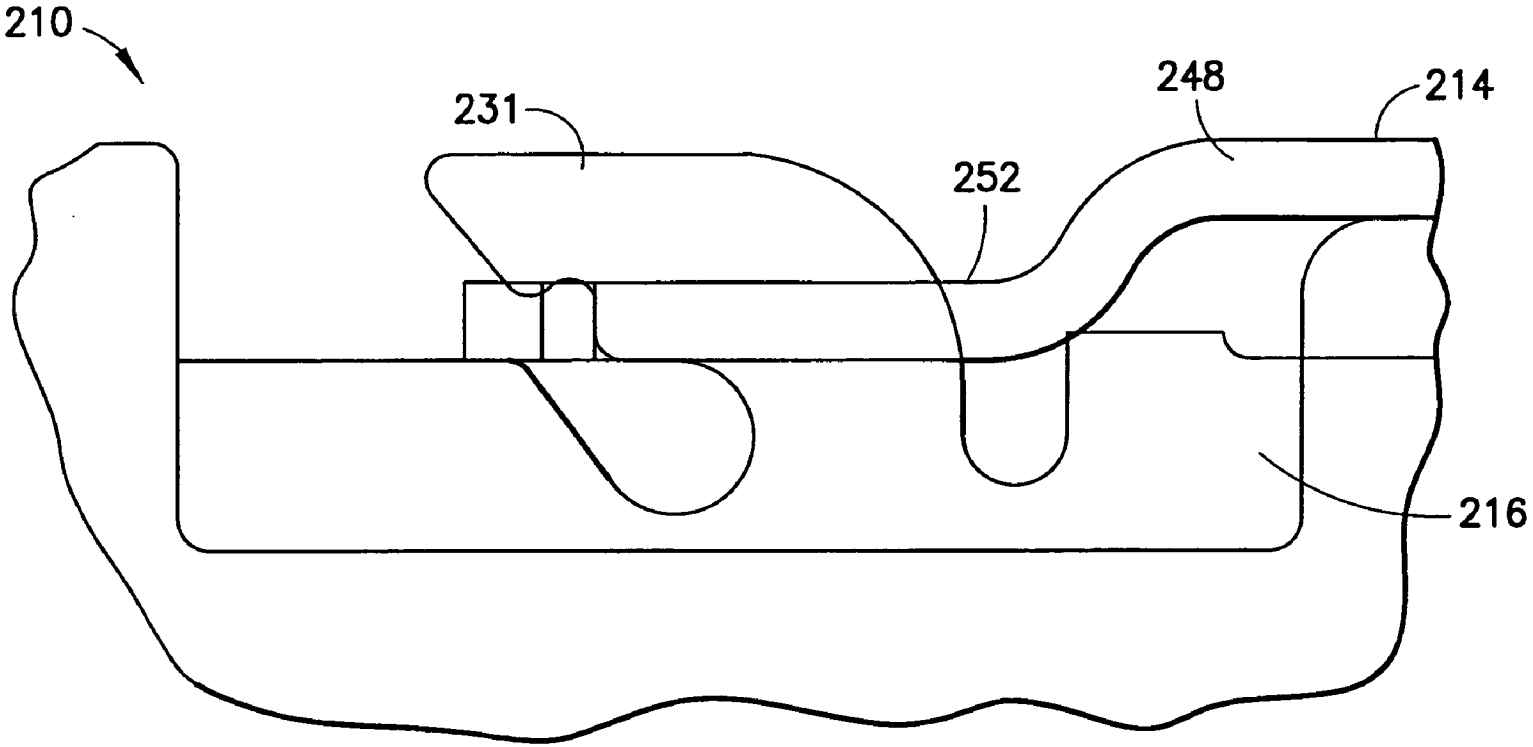
FIG. 31 is an enlarged side view of the alternative backplane connecter shown in FIG. 24 with hidden lines visible.

Referring also to FIGS. 28-31, the retainer 214 attaches to the first side 230 and the second side 234 of the adjacently disposed leadframe assemblies 216. The first latches 231 and the second latches 235 are aligned complementary to the arrangement of the openings 252, 254 in the retainer 214. This allows the first latches 231 and the second latches 235 to engage opposite ends of the retainer 214. The first latches 231 and the second latches 235 function as retention features for the retainer 214. To attach the retainer 214, the second (or rear) latches 235 are inserted into the corresponding second openings (or slots) 254 on the second extending portion 250 of the retainer 214 (as illustrated in FIGS. 28-30). The retainer 214 is then lowered (or rotated counter-clockwise) in place, in a direction towards the first side 230 (as shown by arrow 255). A corner section of the retainer 214 (between the first extending portion 248 and the second extending portion 250) may be deflected into the undercut region 229, by providing a force, to engage the first (or top) latches 231 with the corresponding first openings 252 on the first extending portion 248. After the force is removed, the retainer 214 will spring back and will be retained to the leadframe assemblies 216 (see FIG. 31, hidden lines are shown for clarity). The top latches 231 are deflected by the material thickness of the organizer 214 to ensure electrical contact to PCB ground. It is to be understood that in alternate embodiments, the retainer 214 may alternatively be assembled by attaching the retainer 214 first to the top latches 231 and then to the rear latches 235.

The retainer 214 secures the leadframe assemblies 216 adjacent to one another as the leadframe assemblies 216 are received within the connector module unit 212 to form the backplane connector 210. An end of the connector module unit 212 comprises receptacles suitably sized and shaped to receive contacts from a mating connector.

Figure 32:
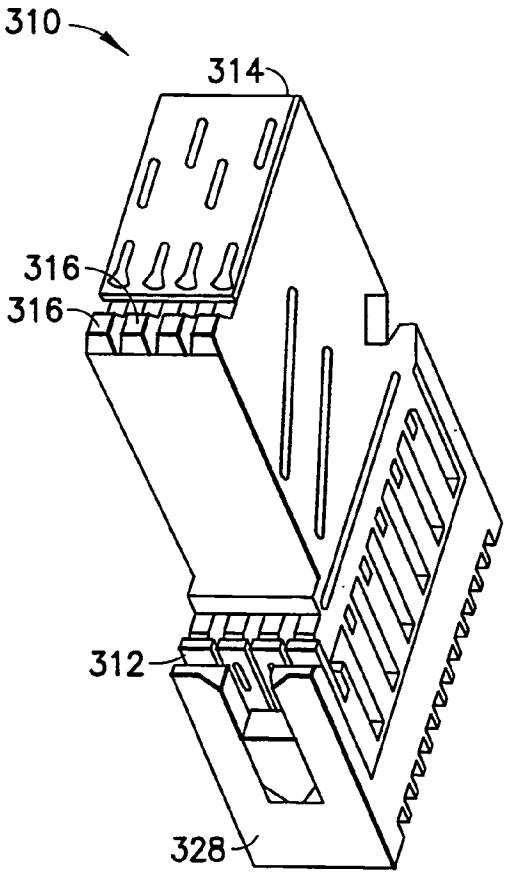
FIG. 32 is a perspective view of another alternative backplane connector engaged with a mating electrical connector.

Referring now to FIG. 32, there is shown a perspective view of a backplane connector 310 in accordance with a fifth embodiment of the present invention. The backplane connector 310 is similar to the backplane connectors 10, 110. The backplane connector 310 is configured to connect with a mating electrical connector 328.

The backplane connector 310, which may be a right angle connector for example, includes a connector module unit (or housing) 312, a retainer 314, and a plurality of leadframe assemblies 316. The leadframe assemblies 316 are fixedly disposed adjacent to one another and supported by the retainer 314. The connector module unit 312 receives the plurality of leadframe assemblies 316 and provides for an electrical connection between the leadframe assemblies 316 and the mating electrical connector 328, which may be a vertical header for example.

Figure 33:
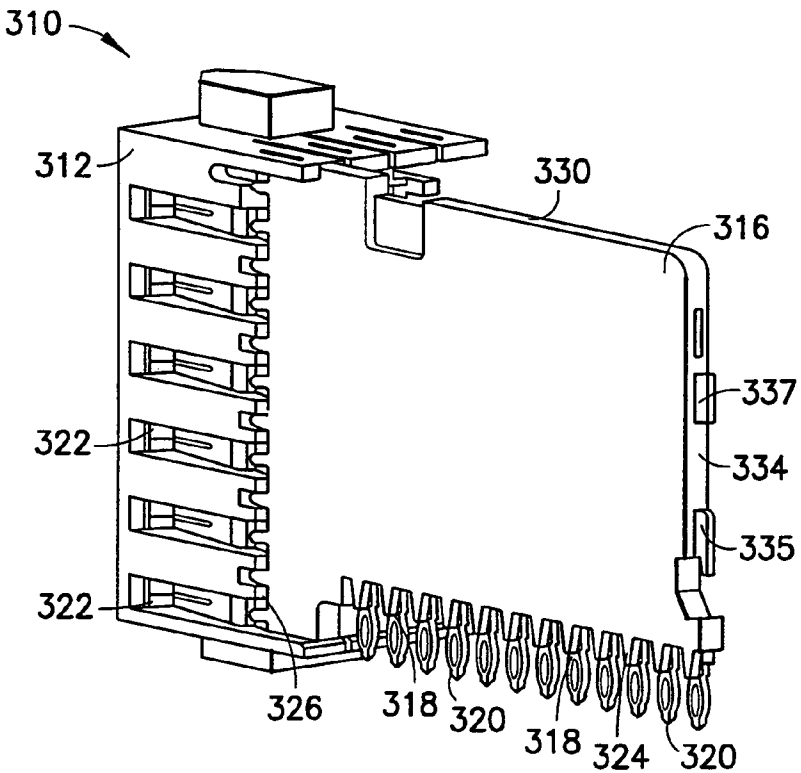
FIG. 33 is a perspective view of the alternative backplane connector shown in FIG. 32.
Figure 34:
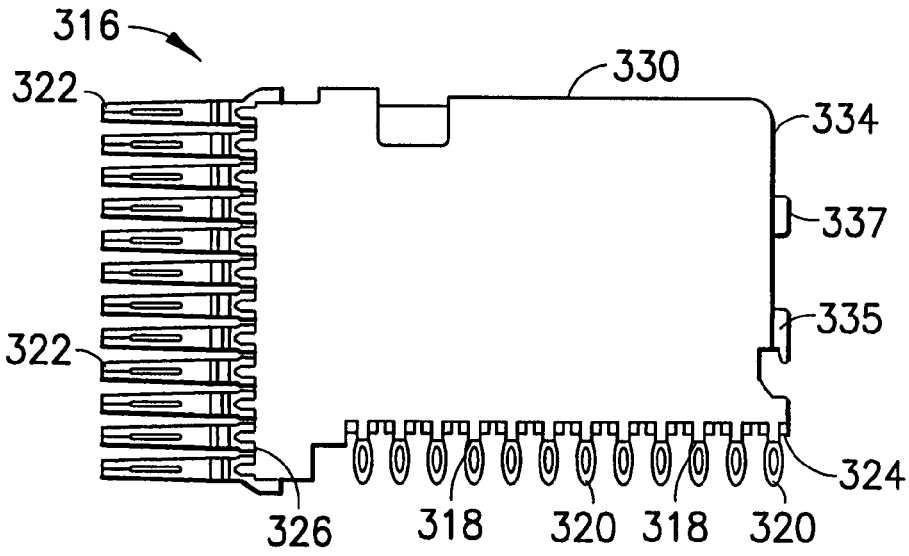
FIG. 34 is a side view of a leadframe assembly used in the alternative backplane connector shown in FIG. 32.

Referring also to FIGS. 33 and 34, each of the leadframe assemblies 316 supports a plurality of electrically conductive contacts 318 as described above for the previous embodiments. Each of the contacts 318 has a terminal end 320 and a mating end 322. The terminal ends 320 extend from a terminal side 324 (opposite a first side 330) and are configured to engage with a printed circuit board or other electronic device (not shown). The mating ends 322 extend from a mating side 326 (opposite a second side 334) and are configured to engage with the connector module unit 312.

One difference between the leadframe assemblies 316 and the leadframe assemblies 116 is the orientation of the second projecting members. Similar to the second projecting members in the second embodiment, the second projecting members on the second side 334 may be latches (or hooks) 335 and alignment features 337. The alignment features 337 of the second sides 334 of the leadframe assemblies 316 are staggered relative to each other best seen in FIGS. 35 and 36. It should be noted that in alternate embodiments, the alignment features 337 may be configured as latches. It should further be understood that although the figures illustrate only the projecting members 337 in a staggered orientation, the projecting members 335 (alone or in combination with the projecting members 337) may also be provided in a staggered orientation. Further, alternative embodiments may also comprise projecting members having a staggered configuration on the first side 330 of the leadframe assemblies 316.

Figure 35:
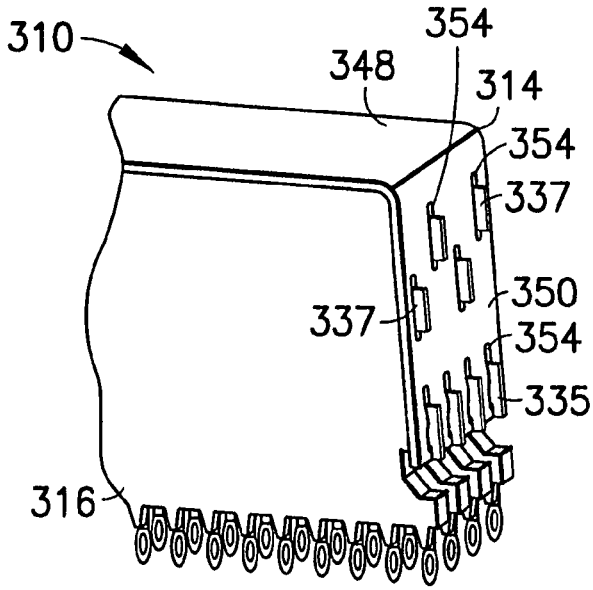
FIG. 35 is a partial perspective view of the alternative backplane connector shown in FIG. 32.
Figure 36:
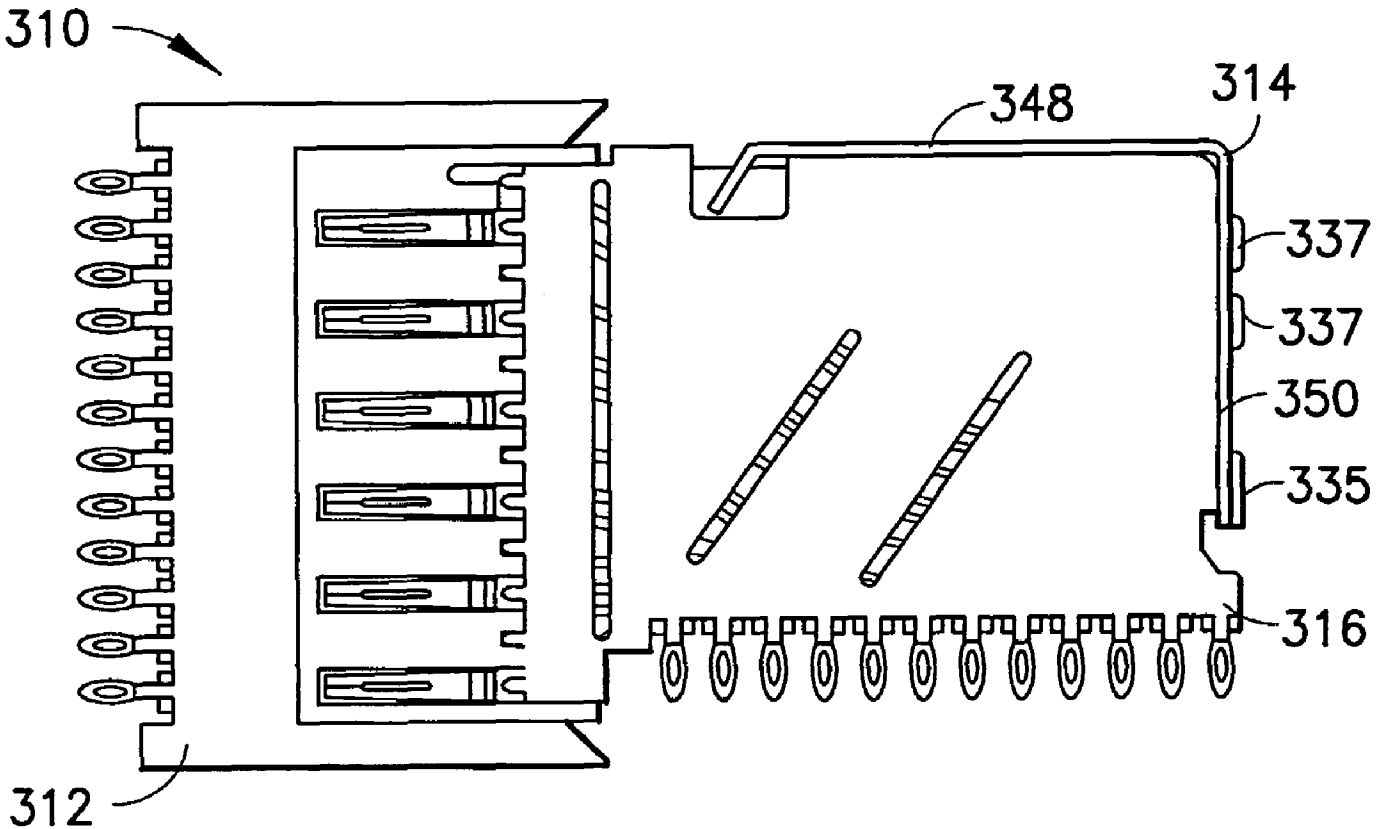
FIG. 36 is a side view of the alternative backplane connector shown in FIG. 32 partially engaged with the mating electrical connector shown in FIG. 32.

Referring also to FIGS. 35 and 36, the retainer (or shield) 314 includes a first extending portion 348 and a second extending portion 350 with second openings 354 as described above for the previous embodiments. One difference between the retainer 314 and the retainer 114 is the orientation of the second openings 354. The second openings 354 are correspondingly staggered to receive the projecting members on the second side 334. It should be noted that although the figures illustrate only the second extending portion as having staggered openings, alternate embodiments having staggered openings on the first extending portion are envisioned.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An organizer for a backplane connector comprising:

a first extending portion comprising a plurality of first openings, wherein the plurality of first openings are configured to receive at least one first projecting member from a first side of a plurality of leadframe assemblies, and wherein an end of the first extending portion is configured to by proximate a mating connector side of the plurality of leadfreame assemblies; and a second extending portion connected to the first extending portion, wherein the second extending portion comprises a plurality of second openings configured to receive at least one second projecting member from a second side of the leadframe assemblies, and wherein the second extending portion comprises at least one contact section configured to be electrically connected to a portion of a printed circuit board.

2. The organizer of claim 1 wherein the organizer is configured to provide electromagnetic shielding.

3. The organizer of claim 1 wherein the first extending portion and the second extending portion are substantially perpendicular to one another.

4. The organizer of claim 1 wherein the organizer is configured to maintain the plurality of leadframe assemblies parallel and adjacent to each other.

5. The organizer of claim 1 wherein the organizer is formed by a stamping process.

6. The organizer of claim 1 wherein the organizer comprises a scored line section along a middle portion of the organizer.

7. An organizer for a backplane connector comprising:

a first extending portion comprising a plurality of first openings, wherein the plurality of first openings are configured to receive at least one first projecting member from a first side of a plurality of leadframe assemblies; and a second extending portion connected to the first extending portion, wherein the second extending portion comprises a plurality of second openings configured to receive at least one second projecting member from a second side of the leadf rams assemblies, wherein the plurality of second openings are staggered with respect to one another, and wherein the second extending portion comprises at least one contact section configured to be electrically connected to an electronic component.

8. An electrical connector comprising a plurality of adjacently disposed leadframe assemblies, wherein the leadframe assemblies are supported by an organizer as in claim 1.

9. An electrical connector comprising:

a plurality of adjacently disposed leadf rams assemblies, wherein each of the leadframe assemblies comprises a first side comprising at least one first projecting member, and wherein each of the leadf rams assemblies comprises a second side comprising at least one second projecting member; and a first retainer comprising a first extending portion and a second extending portion, wherein the first extending portion comprises a plurality of first openings which receive the at least one first projecting members of each of the leadframe assemblies, wherein the second extending portion comprises a plurality of second openings which receive the at least one second projecting members of each of the leadframe assemblies, and wherein at least one of the first projecting members or the second projecting members is in electrical contact with the first retainer.

10. The electrical connector of claim 9 wherein one of the at least one first projecting members is a hook and another one of the at least one first projecting members is an alignment feature.

11. The electrical connector of claim 9 wherein one of the at least one second projecting members is a hook and another one of the at least one second projecting members is an alignment feature.

12. The electrical connector of claim 9 wherein one of the at least one first projecting members is a first latch, and wherein one of the at least one second projecting members is a second latch.

13. The electrical connector of claim 12 wherein the first latch is configured to be deflected by a material thickness of the retainer.

14. The electrical connector of claim 9 wherein the second projecting member of one of the plurality of leadf rams assemblies is staggered from the second projecting member of another one of the plurality of leadframe assemblies.

15. The electrical connector of claim 9 wherein each of the plurality of leadf rams assemblies further comprises an undercnt region along the second side.

16. The electrical connector of claim 15 wherein the undercut region is configured to allow shield deflection during assembly of the electrical connector.

17. The electrical connector of claim 9 wherein the retainer comprises a scored line section along a middle portion of the retainer.

18. The electrical connector of claim 9 further comprising a second retainer adjacently disposed to the first retainer.

19. The electrical connector of claim 9 wherein an orientation of the at least one first projecting members are disposed generally opposite to that of an orientation of the at least one second projecting members.

20. The electrical connector of claim 9 wherein each of the leadframe assemblies has a terminal side opposite the first side and a mating side opposite the second side.

21. An electrical connector comprising:

a plurality of adjacently disposed leadframe assemblies, wherein each of the leadframe assemblies comprises a first side comprising at least one first projecting member, and wherein each of the leadframe assemblies comprises a second side comprising at least one second projecting member; and a first retainer comprising a first extending portion and a second extending portion, wherein the first extending portion comprises a plurality of first openings which receive the at least one first projecting members of each of the leadframe assemblies, wherein the second extending portion comprises a plurality of second openings which receive the at least one second projecting members of each of the leadframe assemblies, and wherein at least one of the first projecting members or the second projecting members is in electrical contact with the first retainer;

wherein a pair of the plurality of leadfrarne assemblies combines to form a slot configured to receive a guide post from a mating electrical connector.

22. A backplane connector comprising:

a plurality of first leadframe assemblies, wherein each of the first leadframe assemblies comprises a recessed portion along a mating side of the leadf rams assembly;

a plurality of second leadframe assemblies, wherein each of the second leadframe assemblies is disposed adjacent to one of the first leadframe assemblies, and wherein each of the second leadframe assemblies comprises a recessed portion along a mating side of the second leadframe assembly; and a leadframe assembly retainer connected to the plurality of first leadframe assemblies and the plurality of second leadframe assemblies, wherein the first leadf rams assemblies and the second leadf rams assemblies are fixedly disposed adjacent to one another, wherein the recessed portions of the first leadframe assemblies and the second leadframe assemblies combine to form a plurality of slots configured to receive a plurality of guide posts from a mating electrical connector, and wherein a width of each of the slots is greater than a width of the individual recessed portions of the first and second leadf rams assemblies.

23. The backplane connector of claim 22 wherein the first leadframe assemblies and the second leadframe assemblies each further comprise a plurality of electrically conductive contacts, wherein terminal ends of the conductive contacts extend from a terminal side of the leadf rams assemblies, wherein the terminal ends are configured to engage with a circuit board, and wherein a first side, opposite the terminal side, comprises at least one projecting member.

24. The backplane connector of claim 23 wherein the projecting members are press-fitted to the leadframe assembly retainer.

25. The backplane connector of claim 22 wherein the first leadframe assemblies and the second leadframe assemblies each further comprise a plurality of electrically conductive contacts, wherein mating ends of the conductive contacts extend from a mating side of the leadf rams assemblies, wherein the mating ends are configured to engage with a mating electrical connector, and wherein a second side, opposite the mating side, comprises at least one projecting member.

26. The backplane connector of claim 25 wherein the leadframe assembly retainer snap-fits over the projecting members.

27. The backplane connector of claim 25 wherein the at least one projecting mewber is a latch.

28. The backplane connector of claim 25 wherein the at least one projecting member of the first leadframe assembly is staggered from the at least one projecting member of the second leadframe assembly.

29. The backplane connector of claim 22 wherein the leadframe assembly further comprises a first mating member and a second mating member, wherein the first mating member and the second mating member extend from the mating side.

30. The backplane connector of claim 22 wherein the leadf rams assembly retainer is configured to provide electromagnetic shielding.

* * * * *

UNITED STATES PATENT AND TRADEMARK OFFICE

CERTIFICATE OF CORRECTION

PATENT NO. : 7,503,804 B2
APPLICATION NO. : 11/726936
DATED : March 17, 2009
INVENTOR(S) : Steven E. Minich It is certified that error appears in the above-identified patent and that said Letters Patent is hereby corrected as shown below:

In Claim 1, Column 11, line 32, delete “by” and replace with --be--.

In Claim 1, Column 11, line 33, delete “leadfreame” and replace with --leadframe--.

In Claim 7, Column 11, line 65, delete “leadf rams” and replace with --leadframe--.

In Claim 9, Column 12, line 7, delete “leadf rams” and replace with --leadframe--.

In Claim 9, Column 12, line 10, delete “leadf rams” and replace with --leadframe--.

In Claim 14, Column 12, line 40, delete “leadf rams” and replace with --leadframe--.

In Claim 15, Column 12, line 44, delete “leadf rams” and replace with --leadframe--.

In Claim 15, Column 12, line 44-45, delete “undercnt” and replace with --undercut--.

In Claim 21, Column 13, line 12, delete “leadfrarne” and replace with --leadframe--.

In Claim 22, Column 13, line 18, delete “leadf rams” and replace with --leadframe--.

In Claim 22, Column 13, line 28, delete “leadf rams” and replace with --leadframe--.

In Claim 22, Column 13, line 29, delete “leadf rams” and replace with --leadframe--.

In Claim 22, Column 13, line 37, delete “leadf rams” and replace with --leadframe--.

In Claim 23, Column 14, line 5, delete “leadf rams” and replace with --leadframe--.

In Claim 25, Column 14, line 16, delete “leadf rams” and replace with --leadframe--.

In Claim 27, Column 14, line 25, delete “mewber” and replace with --member--.

UNITED STATES PATENT AND TRADEMARK OFFICE

CERTIFICATE OF CORRECTION

PATENT NO. : 7,503,804 B2
APPLICATION NO. : 11/726936
DATED : March 17, 2009
INVENTOR(S) : Steven E. Minich It is certified that error appears in the above-identified patent and that said Letters Patent is hereby corrected as shown below:

In Claim 30, Column 14, line 34-35, delete “leadf rams” and replace with --leadframe--.

Signed and Sealed this

Sixteenth Day of June, 2009

John Doll

JOHN DOLL
*Acting Director of the United States Patent and Trademark Office*